US011196219B2

(12) United States Patent
Yang et al.

(10) Patent No.: US 11,196,219 B2
(45) Date of Patent: Dec. 7, 2021

(54) ELECTRICAL CONNECTOR

(71) Applicant: LOTES CO., LTD, Keelung (TW)

(72) Inventors: Qi Xiao Yang, Keelung (TW); Yong Fu Wang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 17/004,195

(22) Filed: Aug. 27, 2020

(65) Prior Publication Data

US 2021/0135403 A1 May 6, 2021

(30) Foreign Application Priority Data

Oct. 30, 2019 (CN) ..... 201911042280.1

(51) Int. Cl.

| | |
|---|---|
| ***H01R 24/00*** | (2011.01) |
| ***H01R 13/6471*** | (2011.01) |
| ***H01R 13/11*** | (2006.01) |
| ***H01R 13/6473*** | (2011.01) |
| *H01R 12/71* | (2011.01) |

(52) U.S. Cl.

CPC ..... *H01R 13/6471* (2013.01); *H01R 13/11* (2013.01); *H01R 13/6473* (2013.01); *H01R 12/712* (2013.01)

(58) Field of Classification Search

CPC .... H01R 13/10; H01R 13/11; H01R 13/6471; H01R 13/6473; H01R 12/71; H01R 12/712

USPC ..... 439/59, 83, 660

See application file for complete search history.

(56) References Cited

U.S. PATENT DOCUMENTS

| | | | | |
|---|---|---|---|---|
| 7,794,278 | B2 | 9/2010 | Cohen et al. | |
| 11,139,618 | B2 * | 10/2021 | Yang | H01R 12/721 |

FOREIGN PATENT DOCUMENTS

| | | | |
|---|---|---|---|
| CN | 100557901 | C | 11/2009 |
| CN | 109314334 | A | 2/2019 |
| CN | 208889897 | U | 5/2019 |

* cited by examiner

*Primary Examiner* — Khiem M Nguyen

(74) *Attorney, Agent, or Firm* — Locke Lord LLP; Tim Tingkang Xia, Esq.

(57) ABSTRACT

An electrical connector electrically connects a first electrical module and a second electrical module, for insertion by the first electrical module along a first direction. The electrical connector includes a first group of terminals arranged in a row along a second direction, having multiple signal terminals and multiple ground terminals and forming at least one first terminal unit and at least one second terminal unit. Each of the terminals has a contact portion, a tail portion, and a middle portion located between the contact portion and the tail portion. In the second direction, the middle portions of the first terminal unit form a first row of the middle portions, and the middle portions of the second terminal unit form a second row of the middle portions. Viewing from the second direction, the first and second rows of the middle portions are staggered, thus improving the crosstalk.

20 Claims, 18 Drawing Sheets

A-A

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201911042280.1 filed in China on Oct. 30, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector with a good crosstalk improvement effect.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has an insulating body, and two rows of terminals provided on the insulating body. Each row of terminals has a plurality of signal units and a plurality of ground terminals alternately provided at intervals. Each signal unit is formed by one signal terminal or one pair of signal terminals transmitting a high-frequency signal. Each of two sides of each signal unit has one ground terminal to improve crosstalk between the signal units.

However, with increasingly high requirements for the signal frequency of the electrical connector, the signal frequency transmitted by each signal unit is increasingly high, and more signal noise will be generated therefrom. In this case, it is not enough to improve the crosstalk between the signal units only by the ground terminals. In common technical solutions, those skilled in the art use a ground member to short-circuit the ground terminals. The ground member has a plurality of abutting portions respectively abutting the ground terminals to enable the ground bridge to short-circuit the ground terminals, such that the ground terminals are electrically connected to one grounding coplane altogether, thereby reducing the inductance of the ground terminals, reducing a return path of the high-frequency signals, and further reducing the crosstalk between the signal units. However, the use of the ground member brings the problems as follows. The ground member and the ground terminals are independently provided. When the abutting portions are mounted on the ground terminals, a mounting tolerance may occur in the mounting process. Alternatively, the abutting portions may be polluted by dust or water. Alternatively, the ground member is usually made of metal, which may cause metal fatigue in the abutting portions during use. Each of the above cases may cause each abutting portion not to well abut the corresponding ground terminal, such that the crosstalk improvement cannot achieve a desired effect. Further, the contact impedance existing between each abutting portion and each ground terminal is not conductive to the crosstalk improvement effect.

Those skilled in the art also provide the ground terminals and the ground member integrally to eliminate the consequences caused by unstable abutting between the abutting portions and the ground terminals and to eliminate the contact impedance between the abutting portions and the ground terminals. However, this operation may cause the signal units and the ground terminals to be respectively connected to different strips, which cannot well guarantee a stable distance from each signal unit to the adjacent ground terminals, and may not achieve a desired crosstalk improvement effect.

Therefore, a heretofore unaddressed need to design a new electrical connector exists in the art to address the aforementioned deficiencies and inadequacies.

SUMMARY

The present invention is directed to an electrical connector, which achieves a good crosstalk improvement effect through a staggered arrangement between the signal terminals and the ground terminals in a first terminal unit and the signal terminals and the ground terminals in an adjacent second terminal unit.

To achieve the foregoing objective, the present invention adopts the following first technical solution.

An electrical connector electrically connects a first electrical module and a second electrical module, and is configured for insertion by the first electrical module along a first direction. The first electrical module has a row of contacts. The electrical connector includes: a plurality of terminals, comprising a first group of terminals arranged in a row along a second direction, wherein the second direction is perpendicular to the first direction, the first group of terminals comprises a plurality of signal terminals and a plurality of ground terminals, the signal terminals and the ground terminals of the first group of terminals form at least one first terminal unit and at least one second terminal unit, each of the first terminal unit and each of the second terminal unit are arranged to be adjacent in the second direction, the first terminal unit is formed by sequentially arranging at least one of the signal terminals and at least one of the ground terminals along the second direction in a configuration mode, and a quantity and a configuration mode of the terminals in the second terminal unit are identical to a quantity and the configuration mode of the terminals in the first terminal unit; wherein each of the terminals has a contact portion, a tail portion electrically connected to the second electrical module, and a middle portion located between the contact portion and the tail portion, the contact portion of each of the terminals in the first group of terminals abuts a same side of one of the contacts of the first electrical module, the middle portions of the terminals in the first terminal unit form a first row of the middle portions in the second direction, the middle portions of the terminals in the second terminal unit form a second row of the middle portions in the second direction, and viewing from the second direction, the first row of the middle portions and the second row of the middle portions are staggered; and an insulating shell, fixed to the first group of terminals.

In certain embodiments, the first terminal unit is formed by one of the signal terminals and one of the ground terminals; or the first terminal unit is formed by a pair of the signal terminals transmitting a differential signal and two of the ground terminals, and the configuration mode of the first terminal unit is that the two of the ground terminals and the pair of the signal terminals are in a "ground-signal-signal-ground" order along the second direction; or the first terminal unit is formed by a pair of the signal terminals and one of the ground terminals, and the configuration mode of the first terminal unit is that the one of the ground terminals and the pair of the signal terminals are in a "signal-signal-ground" order along the second direction.

In certain embodiments, each of the contact portions of the first group of terminals is at least partially provided in a row along the second direction, each of the tail portions of the first group of terminals is at least partially provided in a row along the second direction, an extending size of the middle portion of each of the terminals in the first terminal unit is greater than an extending size of the middle portion of each of the terminals in the second terminal unit; and an extending size of the tail portion of each of the terminals in the first terminal unit is less than an extending size of the tail portion of each of the terminals in the second terminal unit.

In certain embodiments, a third direction is defined to be perpendicular to the first direction and the second direction, the tail portion of each of the terminals has a mounting portion extending in parallel along the third direction and surface-mounted to the second electrical module, and each of the mounting portions of the terminals in the first terminal unit is shorter than each of the mounting portions of the terminals in the second terminal unit.

In certain embodiments, the tail portion of each of the terminals has an oblique transition portion obliquely extending from the middle portion to the tail portion along the third direction, the mounting portions of the tail portions of the terminals define a mounting plane altogether, the oblique transition portions of the terminals in the first terminal unit are farther from the mounting plane than the oblique transition portions of the terminals in the second terminal unit, each of the oblique transition portions of the terminals in the first terminal unit forms a same first included angle relative to the mounting plane, each of the oblique transition portions of the terminals in the second terminal unit forms a second included angle relative to the mounting plane, and the first included angle is equal to the second included angle.

In certain embodiments, the middle portion of each of the first terminals has a fixing portion fixed to the insulating shell, the fixing portions of the terminals in each of the at least one first terminal unit are provided in a same row along the second direction to form a first row of fixing portions, the fixing portions of the terminals in each of the at least one second terminal unit are provided in a same row along the second direction to form a second row of fixing portions, and viewing along the second direction, the first row of fixing portions and the second row of fixing portions are staggered.

In certain embodiments, the middle portion of each of the terminals has a connecting portion extending from the fixing portion and connecting the contact portion and the fixing portion, the connecting portions of the terminals in each of the at least one first terminal unit are provided in a same row along the second direction to form a first row of connecting portions, the connecting portions of the terminals in each of the at least one second terminal unit are provided in a same row along the second direction to form a second row of connecting portions, and viewing along the second direction, the first row of connecting portions and the second row of connecting portions are staggered.

In certain embodiments, a third direction is defined to be perpendicular to the first direction and the second direction, the contact portions of the first group of terminals define a first contact plane altogether, the first contact plane is parallel to the second direction, and the first row of the middle portions is farther from the first contact plane than the second row of the middle portions in the second direction.

In certain embodiments, a third direction is defined to be perpendicular to the first direction and the second direction, the insulating shell is concavely provided with an insertion slot along the first direction to accommodate the first electrical module, each of the first group of terminals is fixed on one side of the insertion slot along the third direction, each of contact portions of the first group of terminals protrudes into the one side of the insertion slot to be electrically connected to the first electrical module, and the first row of the middle portions is farther from the insertion slot than the second row of the middle portions in the third direction.

In certain embodiments, the terminals further comprise a second group of terminals arranged in a row along the second direction and fixed on the other side of the insertion slot along the third direction, and each of the contact portions of the terminals the second group of terminals protrudes into the other side of the insertion slot to be electrically connected to the first electrical module; the second group of terminals comprise a plurality of signal terminals and a plurality of ground terminals, the signal terminals and the ground terminals of the second group of terminals form at least one third terminal unit and at least one fourth terminal unit, the third terminal unit is formed by at least one of the signal terminals and at least one of the ground terminals, and the fourth terminal unit is formed by at least one of the signal terminals and at least one of the ground terminals; and one of the at least one third terminal unit and one of the at least one first terminal unit are provided to be 180-degree inversely symmetrical along the third direction, and one of the at least one fourth terminal unit and one of the at least one second terminal unit are provided to be 180-degree inversely symmetrical along the third direction.

In certain embodiments, each of the contact portions of the terminals in the first terminal unit is connected to a first strip, each of the contact portions of the terminals in the second terminal unit is connected to a second strip, and the first strip and the second strip are provided independently.

In certain embodiments, the insulating shell comprises an insulating block, each of the middle portions of the first group of terminals is fixed to the insulating block by injection molding, a plurality of adjustment holes are concavely formed on a surface of the insulating block, the adjustment holes comprises at least one first hole and at least one second hole, one of the at least one first hole is located between one of the ground terminals and one of the signal terminals of the first terminal unit adjacent to each other, one of the at least one second hole is located between one of the ground terminals and one of the signal terminals of the second terminal unit adjacent to each other, and none of the adjustment holes exists between the first terminal unit and the second terminal unit adjacent to each other.

In certain embodiments, the electrical connector further includes a ground member, wherein the ground member has a main body portion and a plurality of abutting portions connected to the main body portion, the abutting portions have at least one first abutting portion abutting at least one of the ground terminals of the first terminal unit and at least one second abutting portion abutting at least one of the ground terminals of the second terminal unit, and a length of the first abutting portion is not equal to a length of the second abutting portion.

In certain embodiments, the electrical connector further includes a ground member, wherein the ground member has a first main body portion, a second main body portion, at least one first abutting portion connected to the first main body portion and at least one second abutting portion connected to the first main body portion, the first main body portion crosses over one of the at least one first terminal unit along the second direction, one of the at least one first abutting portion abuts a corresponding one of the at least one ground terminal of the first terminal unit, the second main body portion crosses over one of the at least one second terminal unit along the second direction, one of the at least one second abutting portion abuts a corresponding one of the at least one ground terminal of the second terminal unit, and viewing from the second direction, the first main body portion and the second main body portion are staggered.

To achieve the foregoing objective, the present invention adopts the following second technical solution.

An electrical connector is configured for insertion by a first electrical module along a first direction. The first electrical module has a row of contacts arranged along a second direction perpendicular to the first direction. The electrical connector includes: a plurality of terminals, comprising a first group of terminals arranged in a row along a second direction, wherein each of the terminals has a contact portion and a middle portion extending to the contact portion, each of the contact portions of the terminals in the first group of terminals is electrically connected to a same side of each of the contacts in the row of contacts, and each of the middle portions of the terminals in the first group of terminals is located at the same side of each of the contacts in the row of contacts; wherein the terminals comprise a plurality of first ground terminals, a plurality of second ground terminals, a plurality of first signal terminals and a plurality of second signal terminals, at least one of the first ground terminals and at least one of the first signal terminals are provided adjacent to each other to form a first terminal unit, at least one of the second ground terminals and at least one of the second signal terminals are provided adjacent to each other to form a second terminal unit, the first terminal unit and the second terminal unit are arranged adjacent to each other along the second direction, the middle portions of the terminals in the first terminal unit form a first row of the middle portions in the second direction, the middle portions of the terminals in the second terminal unit form a second row of the middle portions in the second direction, and viewing from the second direction, the first row of the middle portions and the second row of the middle portions are staggered; and an insulating shell, fixed to the first group of terminals.

In certain embodiments, each of the first terminal unit has one of the first ground terminals and one of the first signal terminals, and each of the second terminal unit has one of the second ground terminals and one of the second signal terminals, and the configuration mode of each of the second terminal unit and the configuration mode of each of the first terminal unit are identical; or each of the first terminal unit has one of the first ground terminals and a pair of the first signal terminals, thus forming a "signal-signal-ground" configuration mode in the second direction, each of the second terminal unit has one of the second ground terminals and a pair of the second signal terminals, and the configuration mode of each of the second terminal unit and the configuration mode of each of the first terminal unit are identical; or each of the first terminal unit has a pair of the first ground terminals and a pair of the first signal terminals, thus forming a "ground-signal-signal-ground" configuration mode in the second direction, each of the second terminal unit has a pair of the second ground terminals and a pair of the second signal terminals, and the configuration mode of each of the second terminal unit and the configuration mode of each of the first terminal unit are identical.

In certain embodiments, each of the terminals has a tail portion configured to be electrically connected with a second electrical module, the tail portion of each of the terminals enables the middle portion of each of the terminals to be located between the contact portion of each of the terminals and the tail portion of each of the terminals; the tail portion of each of the terminals has a mounting portion and surface-mounted to the second electrical module, and each of the mounting portions of the terminals in the first terminal unit is shorter than each of the mounting portions of the terminals in the second terminal unit.

In certain embodiments, the insulating shell comprises an insulating block, each of the middle portions of the first group of terminals is fixed to the insulating block by injection molding, a plurality of adjustment holes are concavely formed on a surface of the insulating block, the adjustment holes comprises at least one first hole and at least one second hole, one of the at least one first hole is located between one of the ground terminals and one of the signal terminals adjacent to each other, one of the at least one second hole is located between one of the ground terminals and one of the signal terminals adjacent to each other, and none of the adjustment holes exists between the first terminal unit and the second terminal unit adjacent to each other.

In certain embodiments, the electrical connector further includes a ground member, wherein the ground member has a main body portion and a plurality of abutting portions connected to the main body portion, the abutting portions have at least one first abutting portion abutting at least one of the first ground terminals and at least one second abutting portion abutting at least one of the second ground terminals, and a length of the first abutting portion is not equal to a length of the second abutting portion.

In certain embodiments, the electrical connector further includes a ground member, wherein the ground member has a first main body portion, a second main body portion, at least one first abutting portion connected to the first main body portion and at least one second abutting portion connected to the first main body portion, the first main body portion crosses over the first terminal unit along the second direction, one of the at least one first abutting portion abuts one of the first ground terminals, the second main body portion crosses over the second terminal unit along the second direction, one of the at least one second abutting portion abuts one of the second ground terminals, and viewing from the second direction, the first main body portion and the second main body portion are staggered.

Compared with the related art, in the first technical solution, at least one signal terminal of each first terminal unit and at least one signal terminal of the adjacent second terminal unit are two adjacent signal sources, and a crosstalk interference phenomenon may exist between two adjacent signal sources. The first row of middle portions are staggered relative to the second row of middle portions along the left-right direction, increasing an average distance between the two adjacent signal sources, and reducing the crosstalk interference and crosstalk resonance between the two adjacent signal sources. The middle portions of the terminals in each first terminal unit are arranged in the same row, and the middle portions of the terminals in each second terminal unit are arranged in the same row, so as to ensure the signals of the signal terminals to be transmitted stably and more magnetic field energy dispersed by the signal terminals toward the surrounding to return through an adjacent ground terminal, which is conductive to improving the crosstalk, and then improving the crosstalk between the signal terminals of the first group of terminals.

Compared with the related art, in the second technical solution, at least one first signal terminal and at least one second signal terminal are two adjacent signal sources, and the first row of middle portions are staggered relative to the second row of middle portions along the left-right direction, increasing an average distance between the two adjacent signal sources, and reducing the crosstalk interference and crosstalk resonance between the two adjacent signal sources. The middle portions of the terminals in each first terminal unit are arranged in the same row, so as to ensure the signal of the first signal terminal to be stably transmitted. The first signal terminal and one adjacent first ground terminal are provided relatively closely, which is conductive to maintaining impedance balance of the first signal terminal, enabling more energy dispersed by the first signal terminal toward the surrounding to return through the first ground terminal, and improving the crosstalk. Similarly, the middle portions of the terminals in the second terminal unit are arranged in the same row, and thus also having the same effect, which further improves the crosstalk between the first signal terminal and the second signal terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
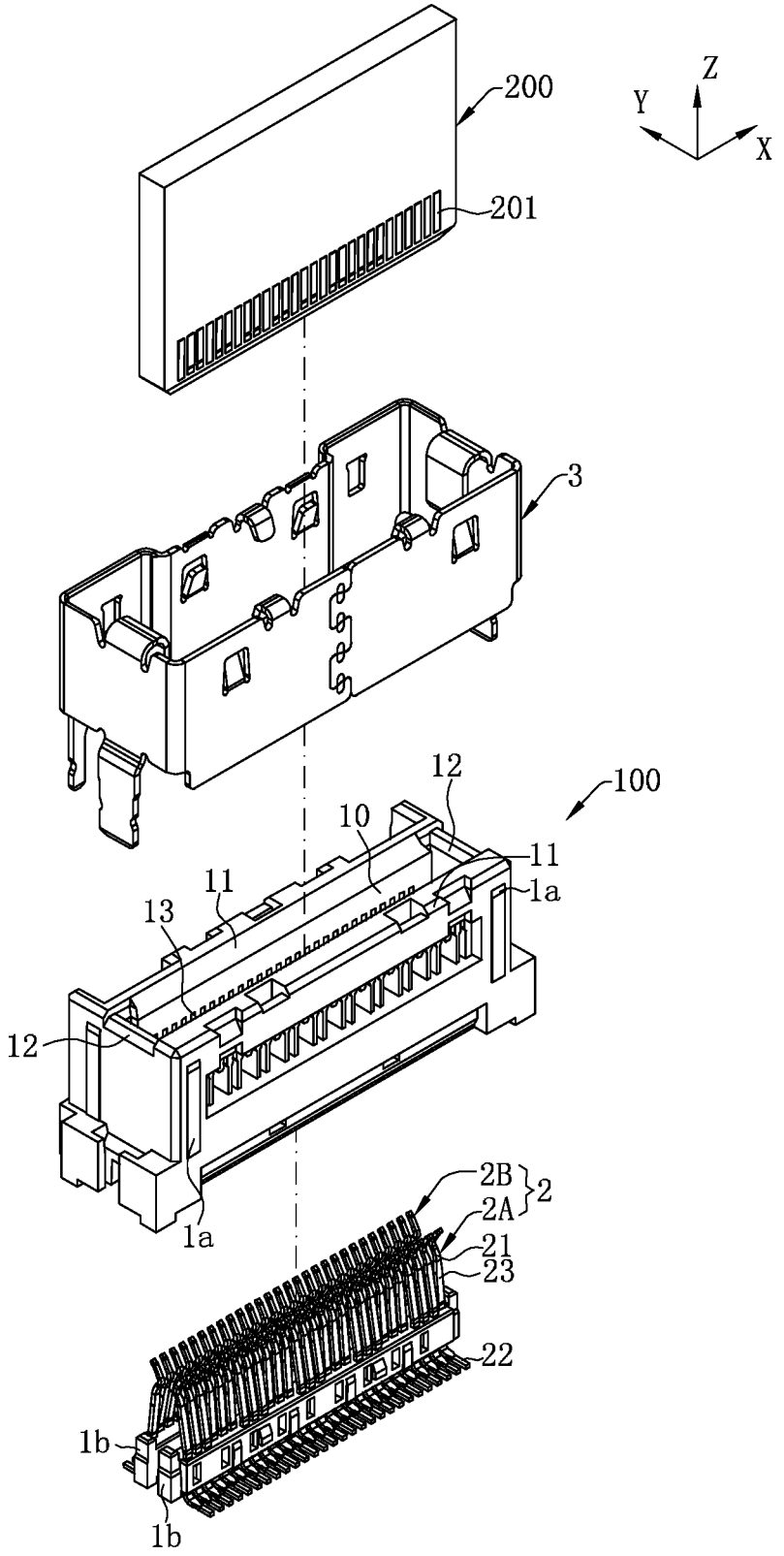
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to an electrical connector.

In order to facilitate understanding, a perspective coordinate axis is defined in accompanying drawings of the embodiments of this description, including a vertical direction (a first direction), and a left-right direction (a second direction) and a front-rear direction (a third direction, also referred to as a width direction) perpendicular to the vertical direction. To facilitate understanding of the accompanying drawings, an upward direction of the vertical direction is a positive direction of the Z-axis, a rightward direction of the left-right direction is a positive direction of the X-axis, and a forward direction of the front-rear direction is a positive direction of the Y-axis.

Figure 9:
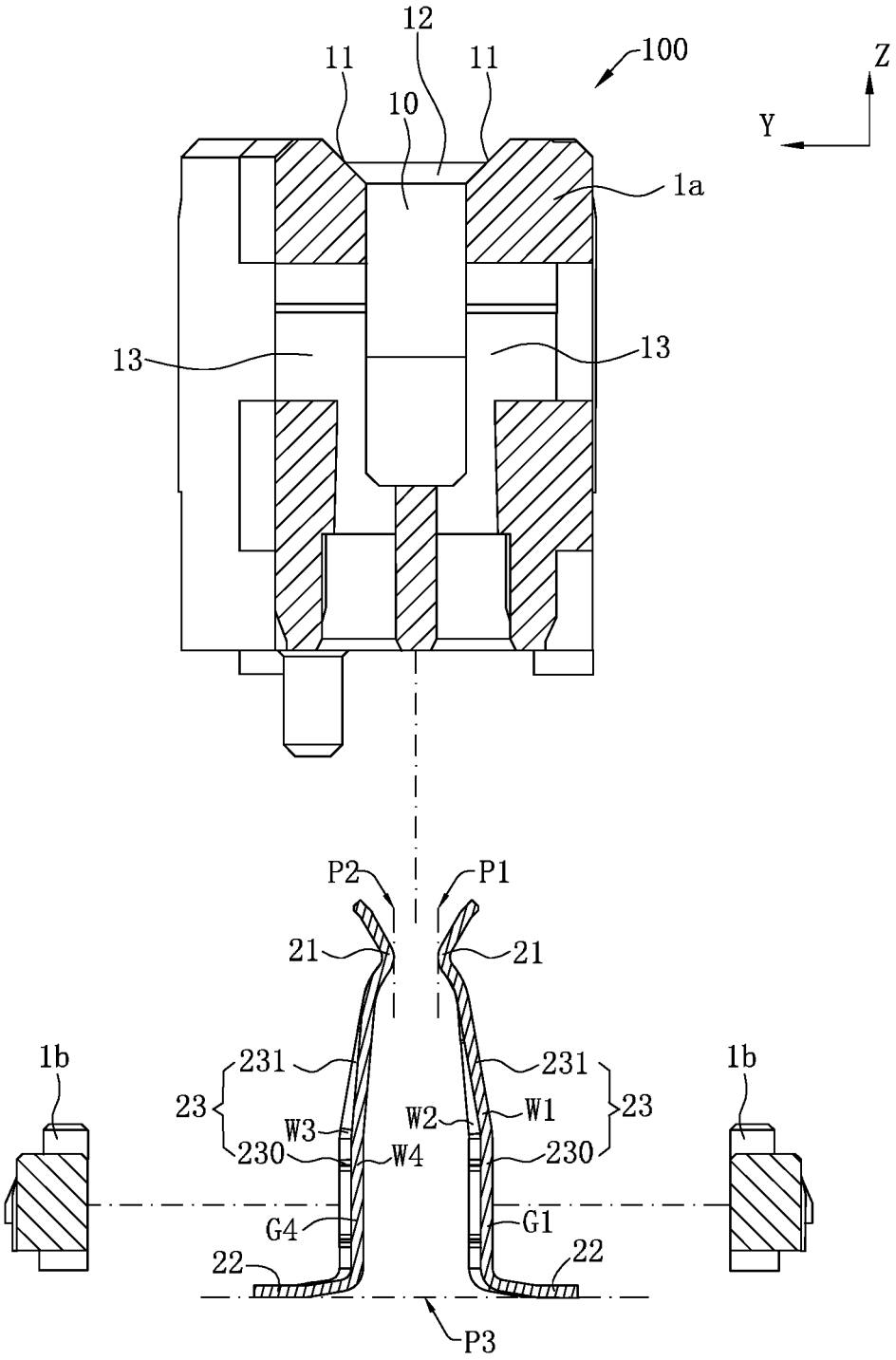
FIG. 9 is a plain exploded view of the electrical connector according to the first embodiment of the present invention.
Figure 10:
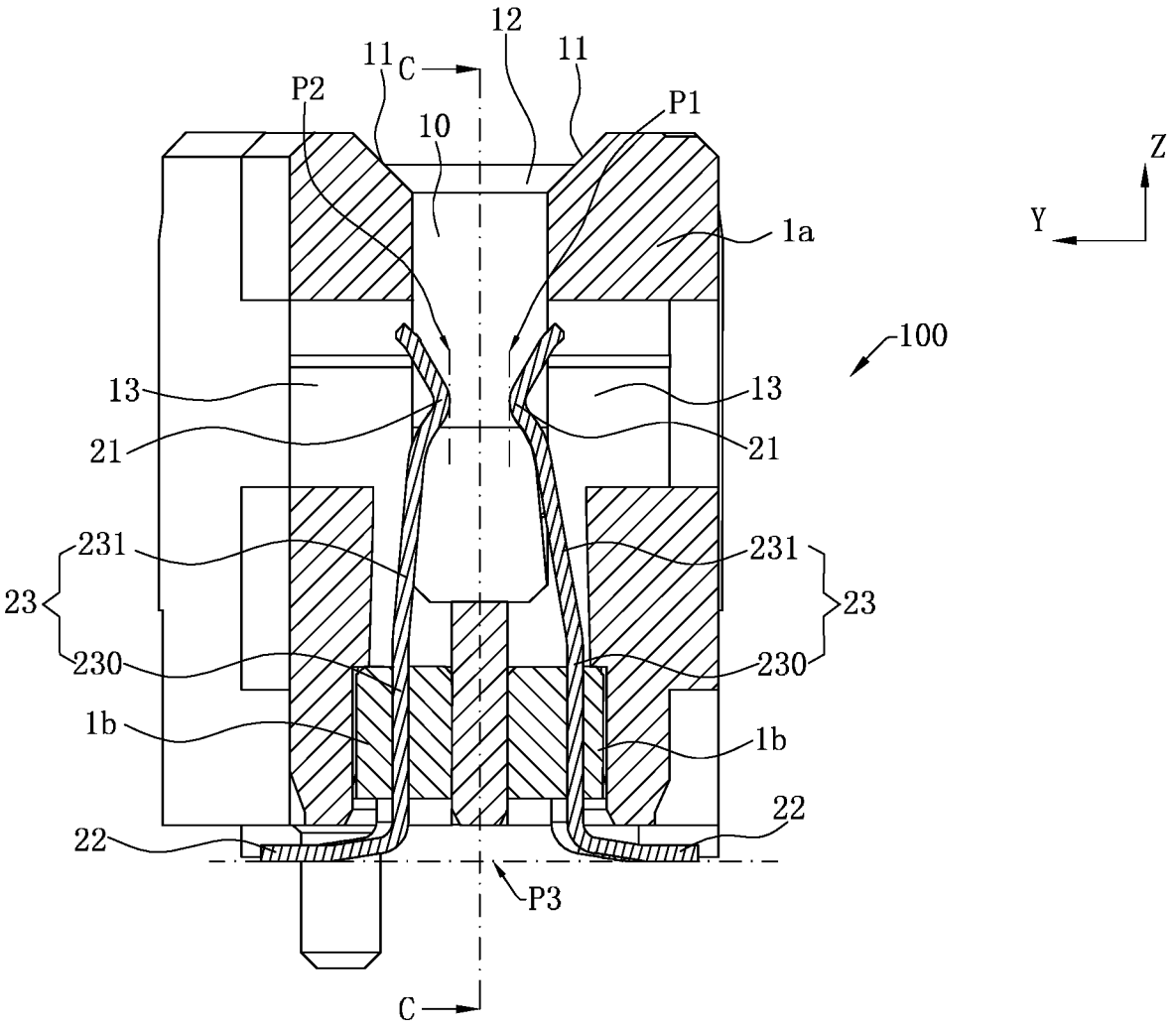
FIG. 10 is a plain assembled view of the electrical connector according to the first embodiment of the present invention.

FIG. 1, FIG. 9 and FIG. 10 show an electrical connector 100 of an embodiment of the present invention, which is configured for insertion by an electronic card 200 along the vertical direction, and is mounted on a mounting surface of a circuit board (not shown) downward from top thereof. Each of two sides of the electronic card 200 along the width direction has a row of contacts 201, and each row of contacts 201 is arranged along the left-right direction. The mounting surface of the circuit board (not shown) has two rows of pads (not shown) parallel in the width direction, and each row of pads (not shown) is arranged along the left-right direction.

Referring to FIG. 1, FIG. 9 and FIG. 10, the electrical connector 100 has an insulating shell 1 provided along the left-right direction lengthwise. The insulating shell 1 has an insertion slot 10 downward concavely provided to accommodate the electronic card 200. A side facing the insertion slot 10 along the width direction is defined as an inner side, and a side away from the insertion slot 10 along the width direction is defined as an outer side. The electrical connector 100 has a plurality of terminals 2 fixed in the insulating shell 1 and respectively fixed at the two outer sides of the insertion slot 10. An upper end of each terminal 2 protrudes into the insertion slot 10 and is electrically connected to each contact 201. A lower end of each terminal 2 extends out of the insulating shell 1 and is electrically connected with each pad (not shown). A metal shell 3 wraps a surrounding surface of the insulating shell 1, so as to shield the terminals 2 fixed in the insulating shell 1.

Referring to FIG. 3, FIG. 7A, FIG. 7B, FIG. 7C and FIG. 10, each terminal 2 has a contact portion 21, a tail portion 22 and a middle portion 23 located between the contact portion 21 and the tail portion 22. Each contact portion 21 partially protrudes into the insertion slot 10 and is electrically connected to one contact 201 of the electronic card 200. A lower end of each contact portion 21 has an arc-shaped transition portion 210 arched outward. The arc-shaped transition portion 210 extends to an upper end of the middle portion 23. Each tail portion 22 extends downward beyond a lower surface of the insulating shell 1 and bends and extends outward. Each tail portion 22 has a mounting portion 220 and an oblique transition portion 221. Each mounting portion 220 is located at a tail end of the tail portion 22, and is formed by horizontally extending outward. Each mounting portion 220 is surface-soldered to one pad (not shown). The oblique transition portion 221 extends obliquely upward and inward from one end of the mounting portion 220 to the middle portion 23. Each middle portion 23 is formed by a fixing portion 230 and a connecting portion 231. The fixing portion 230 is fixed to the insulating shell 1. The fixing portion 230 vertically extends along the vertical direction, and extends downward to the oblique transition portion 221. The connecting portion 231 extends obliquely upward and inward from the fixing portion 230. The connecting portion 231 extends obliquely upward to the arc-shaped transition portion 210.

Referring to FIG. 1, FIG. 9 and FIG. 10, the terminals 2 electrically connected to one row of contacts 201 correspondingly are defined as a first group of terminals 2A, and the terminals 2 electrically connected to the other row of contacts 201 correspondingly are defined as a second group of terminals 2B. The first group of terminals 2A and the second group of terminals 2B are respectively provided at two sides of the insertion slot 10 along the width direction.

Referring to FIG. 3, FIG. 4, FIG. 7A, FIG. 7B and FIG. 7C, the first group of terminals 2A have a plurality of first terminal units W1 and a plurality of second terminal units W2. The first terminal units W1 and the second terminal units W2 are alternately provided rightward from left thereof at intervals. Each first terminal unit W1 is formed by three terminals 2, including one first ground terminal G1 and two first signal terminals S1 for transmitting high-frequency signals, thus forming a "ground-signal-signal" configuration mode rightward from left thereof. In certain embodiments, the configuration mode of each first terminal unit W1 may be a "signal-signal-ground" configuration mode (not shown). Each second terminal unit W2 is also formed by three terminals 2, including one second ground terminal G2 and two second signal terminals S2 for transmitting high-frequency signals, thus forming a "ground-signal-signal" configuration mode or a "signal-signal-ground" configuration mode rightward from left thereof. Each first terminal unit W1 and each second terminal unit W2 both use the same configuration mode. Each two adjacent signal units in the first group of terminals 2A include one pair of first signal terminals S1 and one pair of second signal terminals S2.

Figure 17:
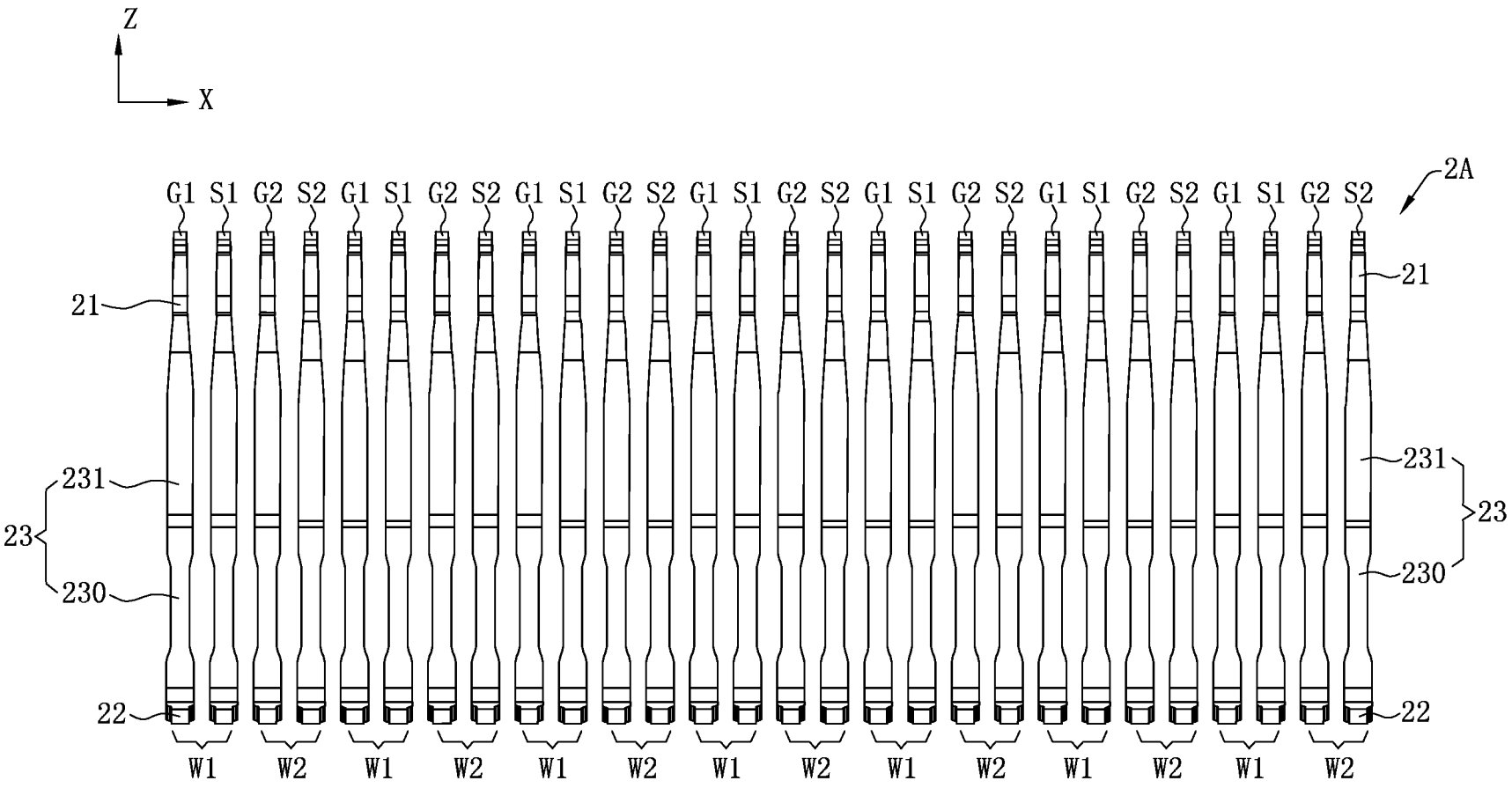
FIG. 17 is a plain view of a first group and a second group of terminals of an electrical connector according to a fourth embodiment of the present invention viewing from outside thereof.
Figure 18:
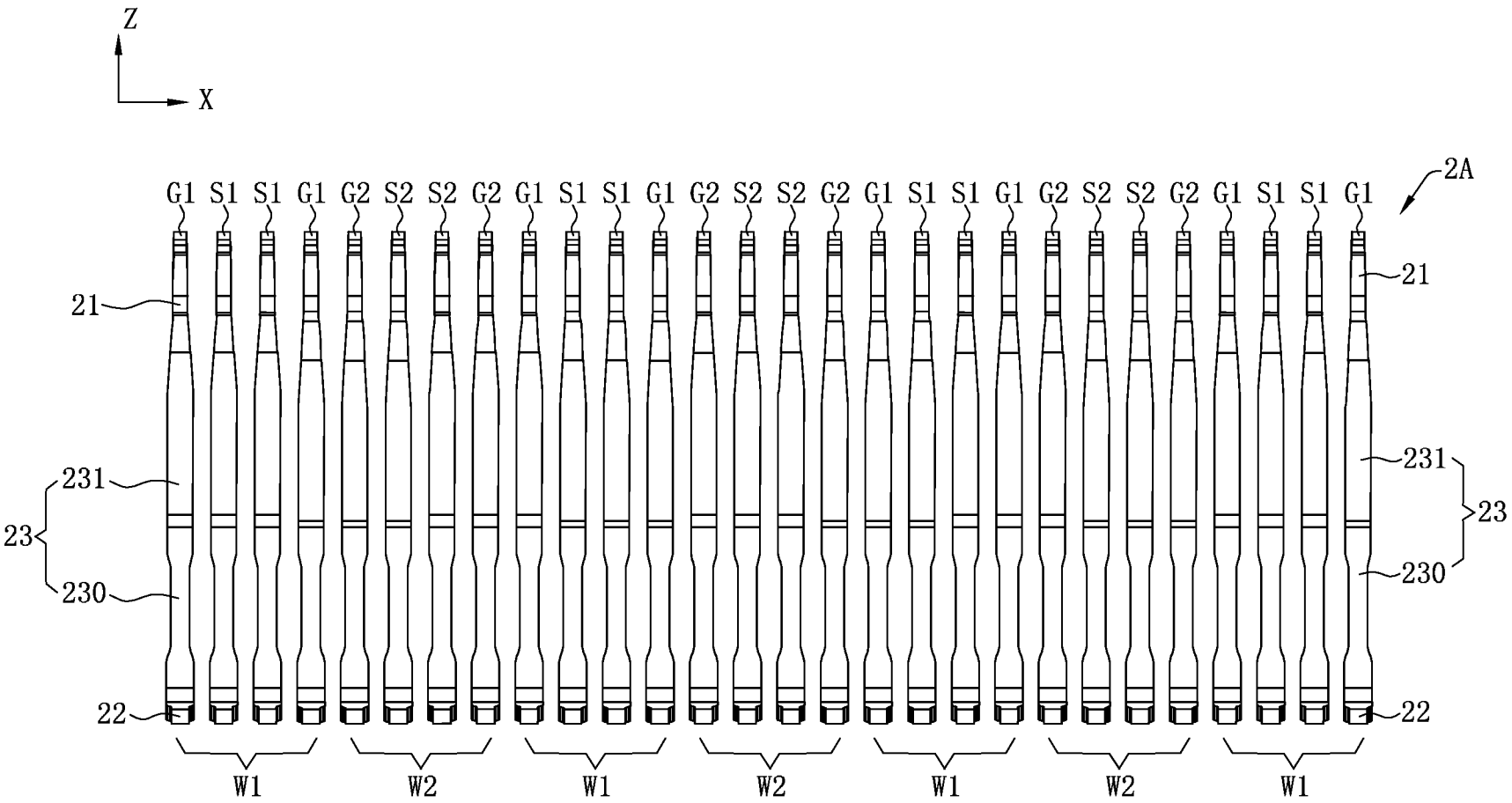
FIG. 18 is a plain view of a first group and a second group of terminals of an electrical connector according to a fifth embodiment of the present invention viewing from outside thereof.

Referring to FIG. 17 and FIG. 18, in other embodiments, the configuration mode may be adjusted differently according to design requirements. Several cases are listed as below: each first terminal unit W1 is formed by two terminals 2, including one first ground terminal G1 and one first signal terminal S1, thus forming a "ground-signal" configuration mode rightward from left thereof. In certain embodiments, the configuration mode of each first terminal unit W1 may be a "signal-ground" configuration mode (not shown) rightward from left thereof. Further, the quantity and the configuration mode of the terminals in each second terminal unit W2 are identical to the quantity and the configuration mode of the terminals in each first terminal unit W1. Alternatively, each first terminal unit W1 is formed by four terminals 2, including two first ground terminals G1 and two first signal terminals S1, thus forming a "ground-signal-signal-ground" configuration mode rightward from left thereof, and the quantity and the configuration mode of the terminals in each second terminal unit W2 are identical to the quantity and the configuration mode of the terminals in each first terminal unit W1.

Referring to FIG. 1 and FIG. 10, the contact portions 21 of the first group of terminals 2A are provided in a row rightward from left thereof at a same contact center distance, and define a first contact plane P1 altogether. The first contact plane P1 is parallel to the left-right direction and the vertical direction. One row of contact portions 21 of the first group of terminals 2A are in electrical contact with the same side of one row of contacts 201.

Referring to FIG. 1, FIG. 7A, FIG. 7B and FIG. 7C, the mounting portions 220 of the first group of terminals 2A are provided in a row along the left-right direction at a same mounting center distance, and are one-by-one surface-soldered to one row of pads (not shown).

Figure 4:
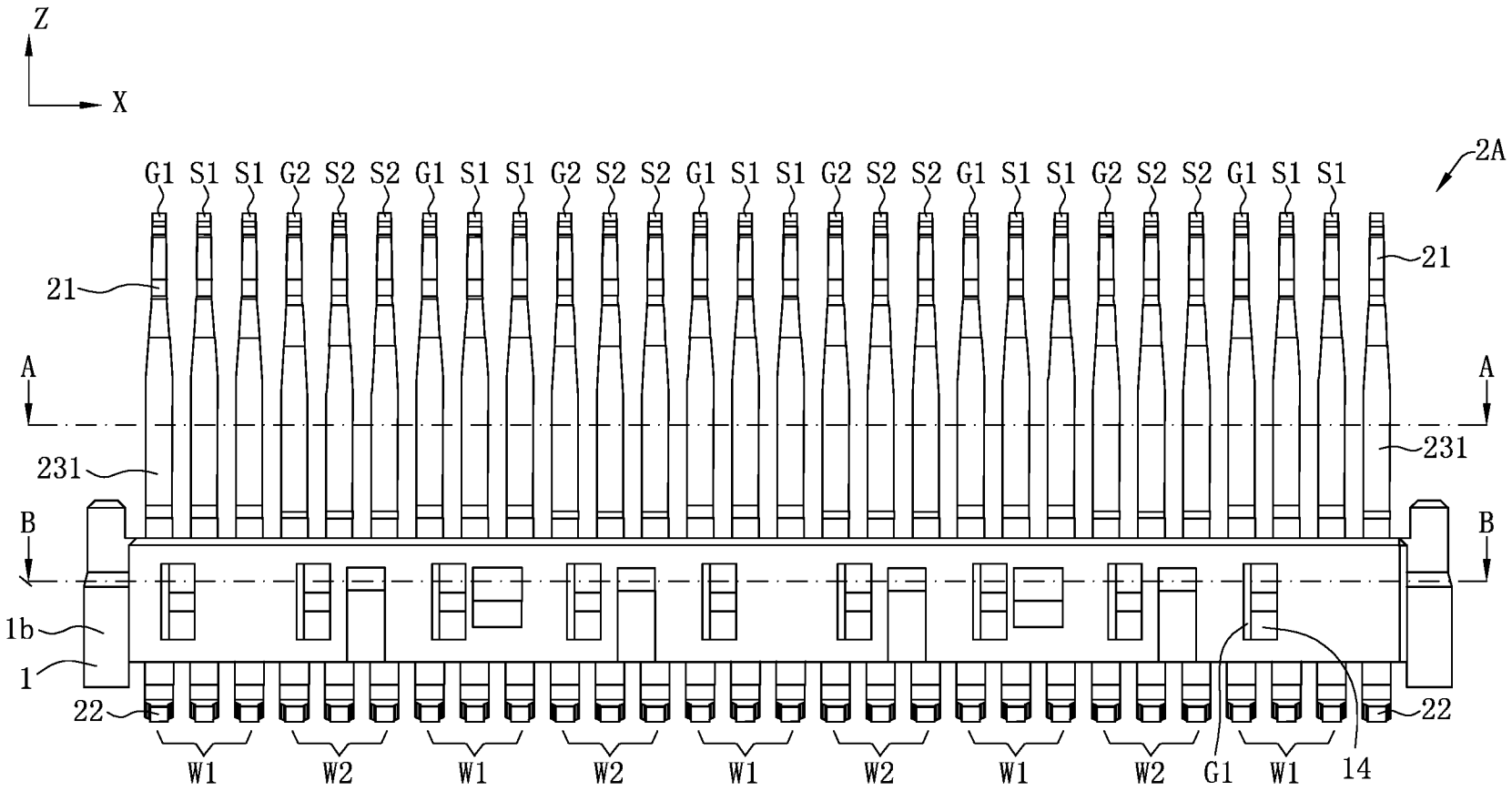
FIG. 4 is a plain view of first and second modules of the electrical connector according to the first embodiment of the present invention viewing from an outer side.
Figure 5:
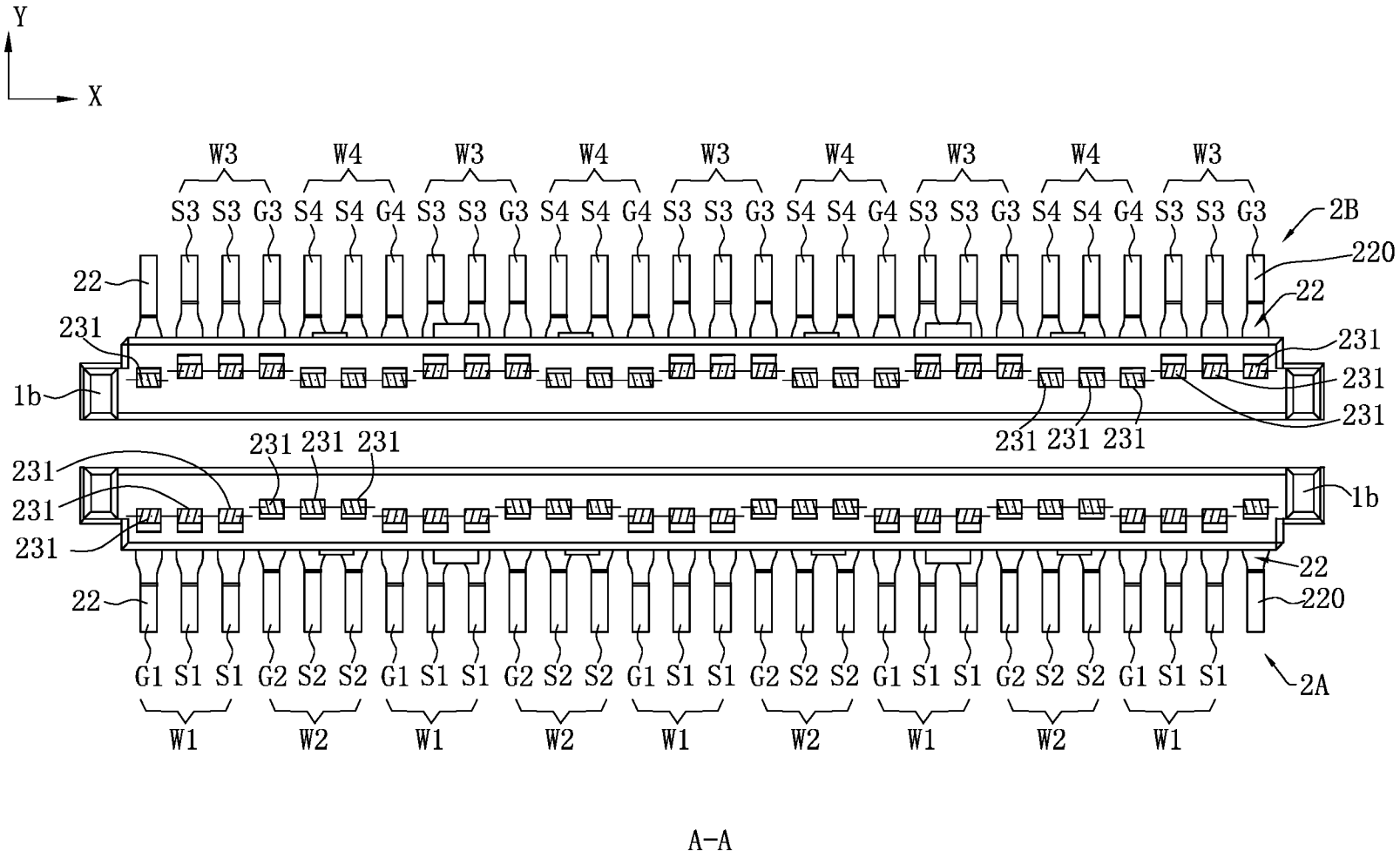
FIG. 5 is a sectional view of FIG. 4 along a line A-A.
Figure 7A:
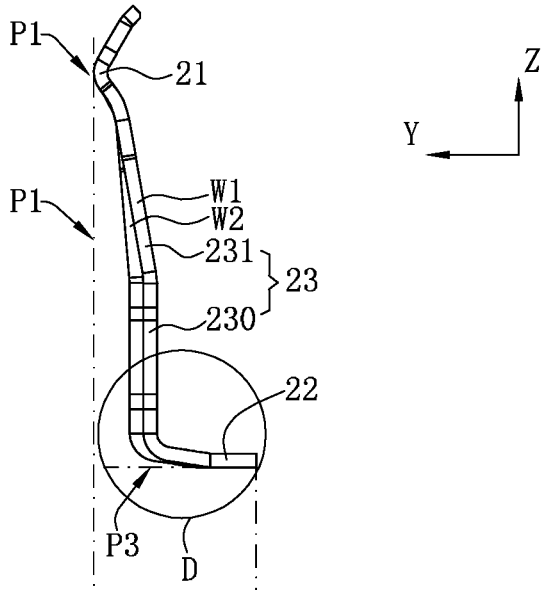
FIG. 7A is a plain view of the first group of terminals of the electrical connector according to the first embodiment of the present invention viewing along a left-right direction.
Figure 7B:
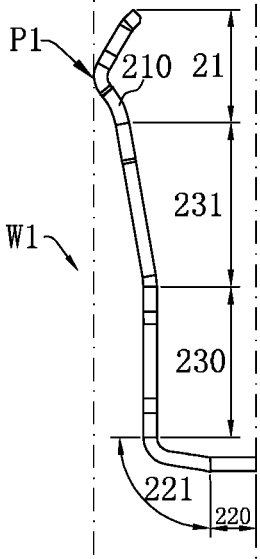
FIG. 7B is a plain view of a first terminal unit in the first group of terminals of the electrical connector according to the first embodiment of the present invention viewing along the left-right direction.
Figure 7C:
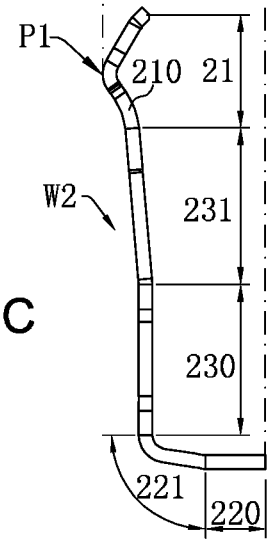
FIG. 7C is a plain view of a second terminal unit in the first group of terminals of the electrical connector according to the first embodiment of the present invention viewing along the left-right direction.

Referring to FIG. 4, FIG. 5, FIG. 7A, FIG. 7B and FIG. 7C, and further referring to FIG. 5 and FIG. 7B, the connecting portions 231 of the terminals 2 in each first terminal unit W1 are provided in a row along the left-right direction to form a first row of the connecting portions 231. Referring to FIG. 5 and FIG. 7C, the connecting portions 231 of the terminals 2 in each second terminal unit W2 are provided in a row along the left-right direction to form a second row of the connecting portions 231. Referring to FIG. 5 and FIG. 7A, viewing along the left-right direction, the first row of connecting portions 231 and the second row of connecting portions 231 are staggered. Further, referring to FIG. 5, FIG. 9 and FIG. 10, in the width direction, the first row of connecting portion 231 is farther from the first contact plane P1 and the insertion slot 10 than the second row of connecting portions 231. That is, the first row of connecting portions 231 is close to an outer side relative to the second row of connecting portions 231.

Figure 3:
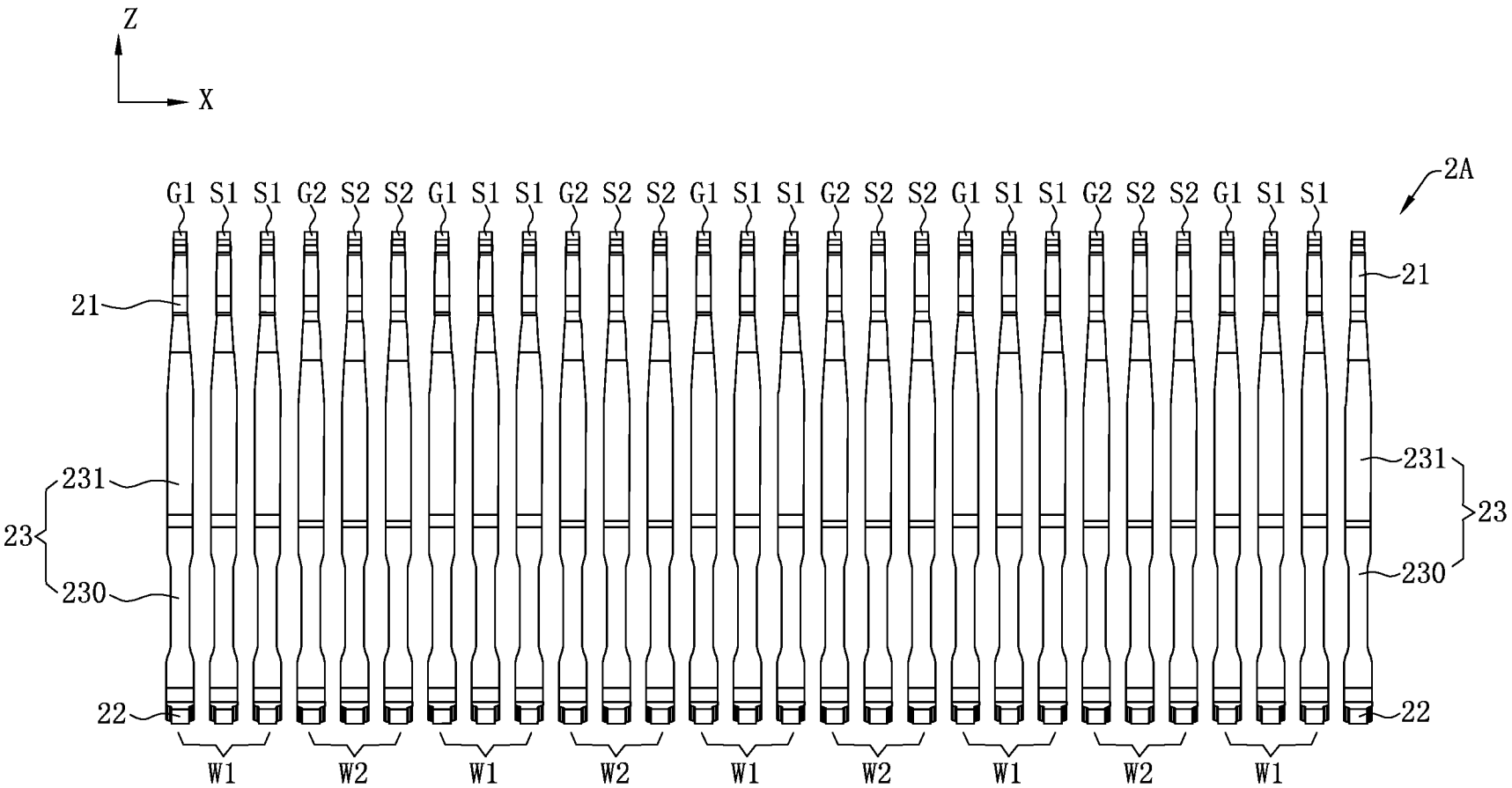
FIG. 3 is a plain view of first and second groups of terminals of the electrical connector according to the first embodiment of the present invention viewing from an outer side.

Referring to FIG. 3, FIG. 4 and FIG. 5, the two adjacent signal units along the left-right direction in this embodiment of the present invention include a pair of first signal terminals S1 and a pair of second signal terminals S2. The first row of connecting portions 231 deviates outward relative to the second row of connecting portions 231. Compared with the related art where there is no deviation between adjacent terminal units (one terminal unit has one pair of signal terminals and one adjacent ground terminal) in one row of terminals, in this embodiment of the present invention, an average distance between the connecting portions 231 of two adjacent signal units is increased. When the high-frequency signals are transmitted from the electronic card 200 to the contact portions 21, the average distance between the connecting portions 231 relatively close to the contact portions 21 is increased, such that the near-end crosstalk interference and near-end crosstalk resonance between the first signal terminals S1 and the second signal terminals S2 may be reduced. The connecting portions 231 of the terminals 2 in each first terminal unit W1 are provided in a same row, so as to ensure the high-frequency signals between the connecting portions 231 of one pair of first signal terminals S1 to be stable in energy coupling and the pair of first signal terminals S1 to be relatively close to one adjacent first ground terminal G1, thereby reducing the loop of the high-frequency signals in the pair of first signal terminals S1, which is conductive to maintaining the impedance balance of the first signal terminals S1 and enabling more energy dispersed by the connecting portions 231 of the first signal terminals S1 to the surrounding to return through the connecting portion 231 of the first ground terminal G1, and is conductive to improving near-end crosstalk. The connecting portion 231 of the terminals 2 in each second terminal unit W2 are provided in a same row, and also has the same effect, and descriptions thereof are not further elaborated herein.

Figure 12:
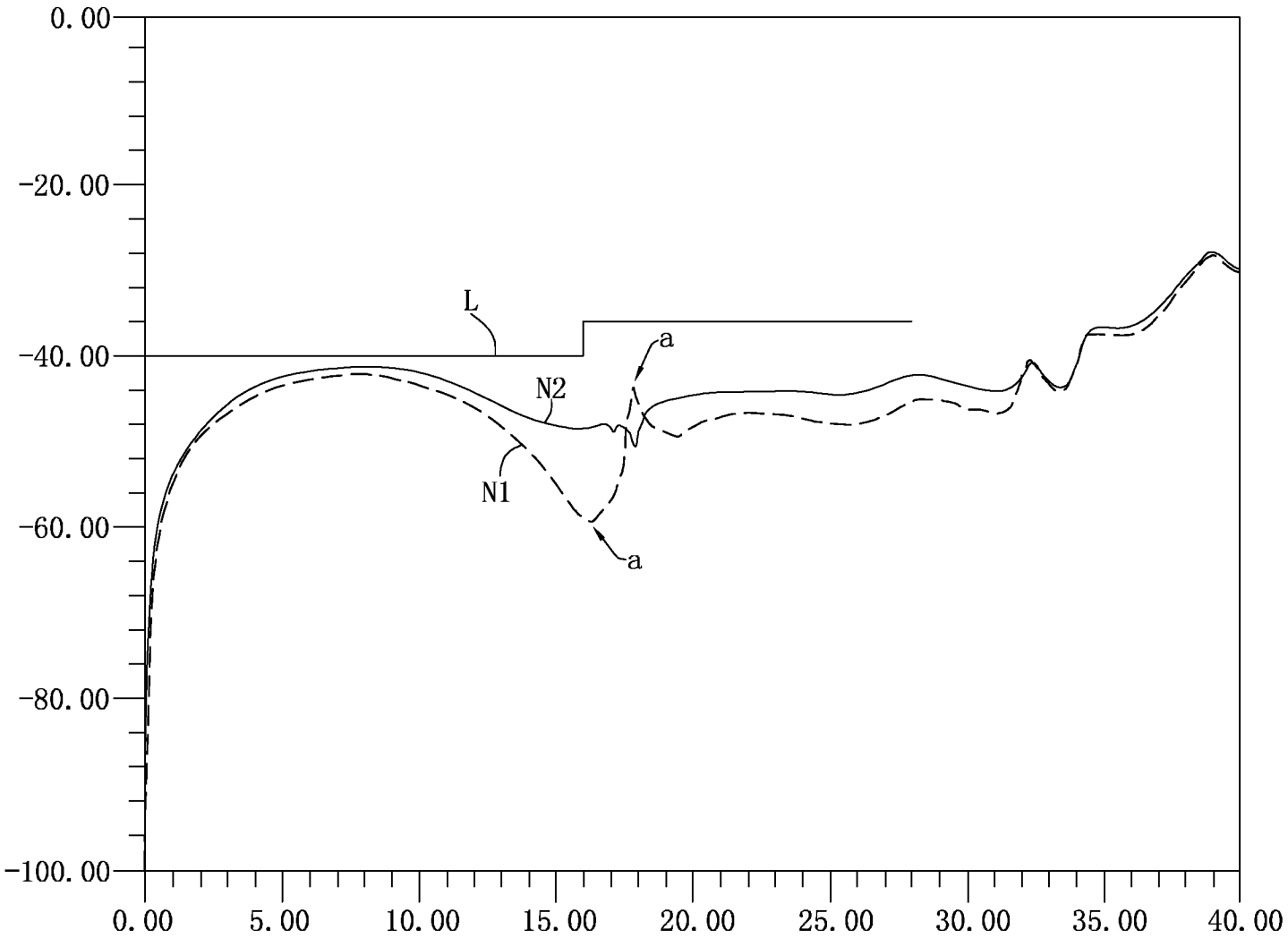
FIG. 12 is a curve chart of near-end crosstalk of the first group of terminals of the electrical connector according to the first embodiment of the present invention compared with the related art.

FIG. 12 shows a curve chart of the near-end crosstalk, where L is a general standard line of the crosstalk in the art, N1 is a curve chart of the near-end crosstalk in the related art, and N2 is a curve chart of the near-end crosstalk of the first group of terminals 2A of the electrical connector 100 in this embodiment of the present invention. It can be seen that the curve N2 is closer to the standard line L relative to the curve N1. There are multiple sharp crosstalk resonance points a on the curve N1, which indicate that a near-end crosstalk resonance phenomenon occurs for many times in a signal transmission process of the electrical connector 100 in the related art and affects energy transmission between the electronic card 200 and the contact portions 21. Compared with the curve N1, the curve N2 improves the sharp resonance points a on the curve N1 and reduces the near-end crosstalk interference, and is overall relatively mild relative to the curve N1, such that the crosstalk interference to the high-frequency signals during the transmission on the connecting portions 231 is reduced.

Referring to FIG. 3, FIG. 4, FIG. 6 and FIG. 9, the fixing portions 230 of the terminals 2 in each first terminal unit W1 are provided in a row along the left-right direction to form a first row of fixing portions 230. The fixing portions 230 of the terminals 2 in each second terminal unit W2 are provided in a row along the left-right direction to form a second row of fixing portions 230. Viewing along the left-right direction, the first row of fixing portions 230 and the second row of fixing portions 230 are staggered. In the width direction, the first row of fixing portions 230 is farther from the first contact plane P1 and the insertion slot 10 than the second row of fixing portions 230. That is, the first row of fixing portions 230 is close to the outer side relative to the second row of fixing portions 230. The fixing portions 230 are relatively close to the mounting portions 220 (referring to FIG. 7B and FIG. 7C). The mounting portions 220 are configured to transmit the high-frequency signals to the circuit board (not shown). Compared with the related art where there is no deviation between adjacent terminal units (one terminal unit has one pair of signal terminals and one adjacent ground terminal) in one row of terminals, in this embodiment of the present invention, the first row of fixing portions 230 of the electrical connector 100 deviates outward relative to the second row of fixing portions 230, thereby increasing an average distance between each first terminal unit W1 and each second terminal unit W2, and reducing far-end crosstalk interference. On the basis that the connecting portions 231 of the terminals 2 in each first terminal unit W1 are provided in a same row, the fixing portions 230 of the terminals 2 in each first terminal unit W1 are also provided in a same row, further enlarging a directly facing area between one pair of first signal terminals S1 and ensuring a stable distance between the pair of first signal terminals S1, thereby further ensuring the pair of first signal terminals S1 to be stable in energy coupling. In addition, a directly facing area between the first ground terminal G1 and the adjacent first signal terminal S1 is also enlarged, such that more interference crosstalk energy dispersed by the first signal terminal S1 to the surrounding flows back through the first ground terminal G1, and the far-end crosstalk interference is reduced. The fixing portions 230 of the terminals 2 in each second terminal unit W2 are provided in a same row, and also has a same effect, and descriptions thereof are not further elaborated herein.

Figure 13:
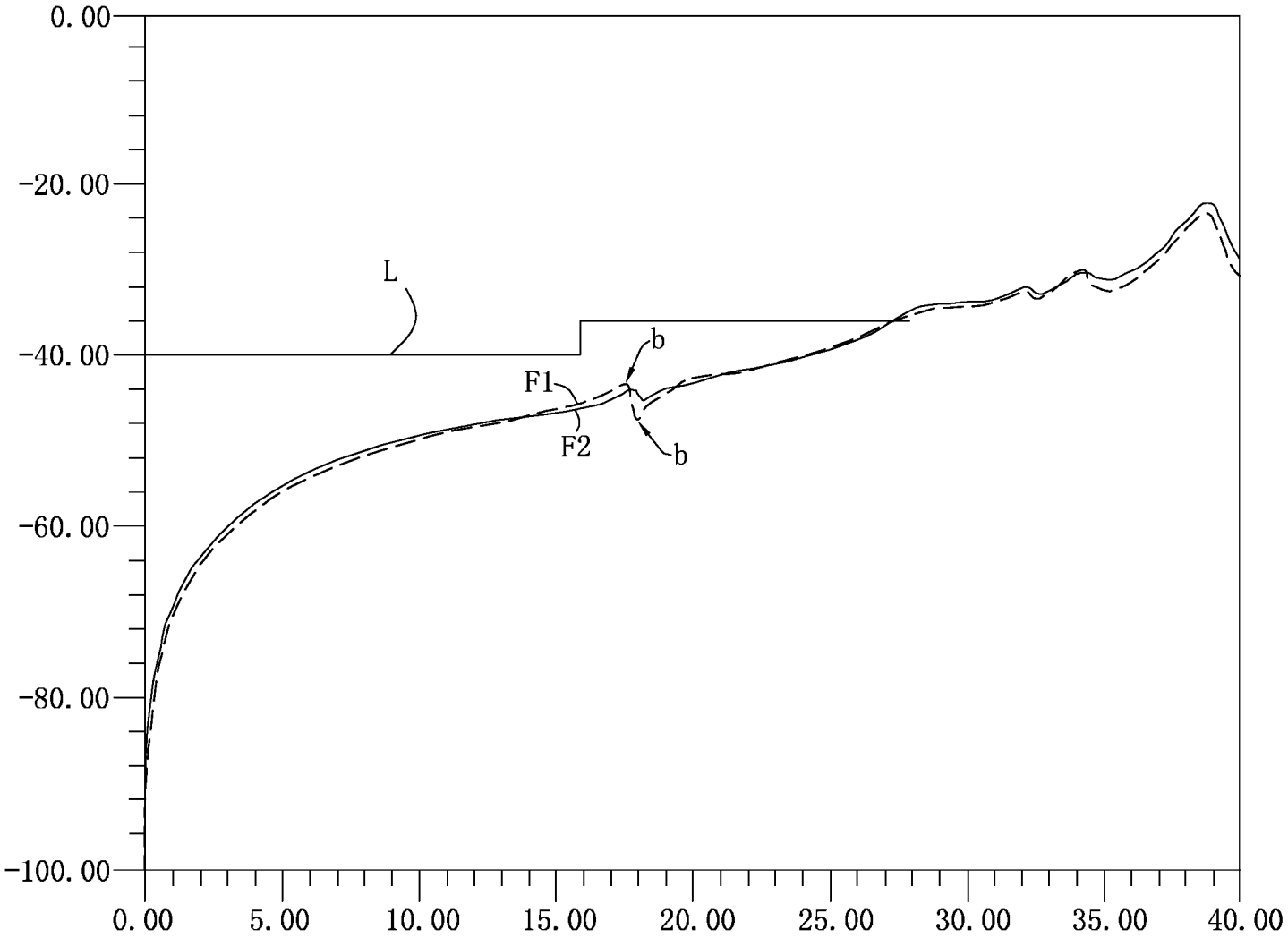
FIG. 13 is a curve chart of far-end crosstalk of the first group of terminals of the electrical connector according to the first embodiment of the present invention compared with the related art.

FIG. 13 shows a curve chart of far-end crosstalk, where L is a general standard line of the crosstalk in the art, F1 is a curve chart of the far-end crosstalk in the related art, and F2 is a curve chart of the far-end crosstalk of the first group of terminals 2A of the electrical connector 100 in this embodiment of the present invention. It can be seen that multiple sharp crosstalk resonance points b appearing on the curve F1 are improved on the curve F2, such that compared with the related art, the electrical connector 100 in this embodiment of the present invention improves the far-end crosstalk interference.

Figure 8:
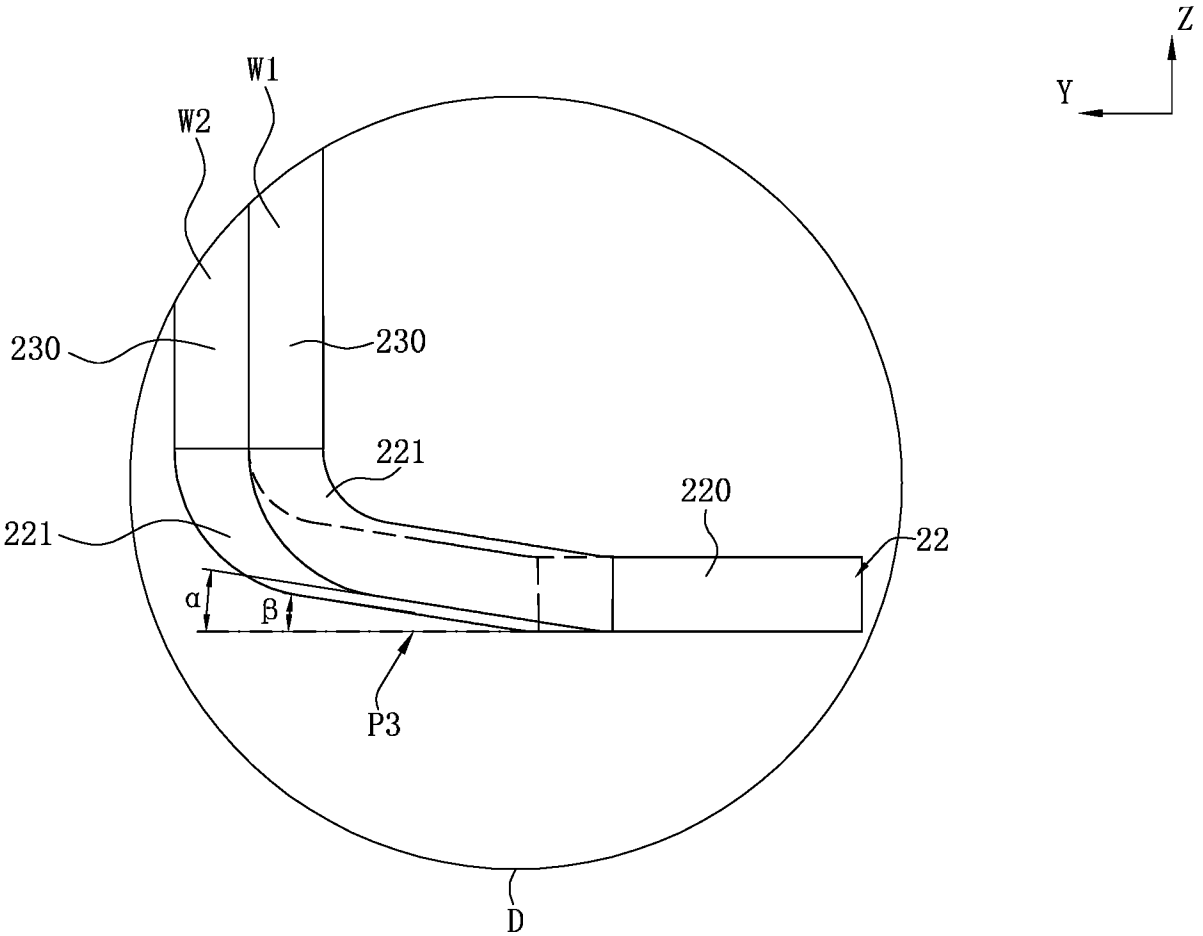
FIG. 8 is a partially enlarged view in FIG. 7A.

Referring to FIG. 7A, FIG. 7B and FIG. 7C, the scales of FIG. 7A, FIG. 7B and FIG. 7C are equal. Each middle portion 23 is formed by the fixing portion 230 configured to fix the terminal 2 and the connecting portion 231 extending from the fixing portion 230. Referring to FIG. 7B, the first row of fixing portions 230 and the first row of connecting portions 231 form a first row of middle portions 23. Referring to FIG. 7C, the second row of fixing portions 230 and the second row of connecting portions 231 form a second row of middle portions 23. Referring to FIG. 7A, viewing rightward from left thereof, the first row of middle portions 23 as a whole deviates outward relative to the second row of middle portions 23 as a whole. The first row of middle portions 23 deviates outward relative to the second row of middle portions 23, such that an extending size of each middle portion 23 of the first row of middle portions 23 is greater than an extending size of each middle portion 23 of the second row of middle portions 23. Referring to FIG. 8, in order to balance a signal transmission length of each terminal 2 of the first group of terminals 2A, the overall impedance balance of the first group of terminals 2A is maintained, such that an extending size of each mounting portion 220 of the terminals 2 in each first terminal unit W1 is less than an extending size of each mounting portion 220 of the terminals 2 in each second terminal unit W2 (referring to FIG. 7B and FIG. 7C). The first row of middle portions 23 deviates outward relative to the second row of middle portions 23. Compared with the related art, the electrical connector 100 according to this embodiment of the present invention increases an average distance between two adjacent signal units and reduces the overall crosstalk interference and the overall crosstalk resonance between the first signal terminals S1 and the second signal terminals S2.

Figure 14:
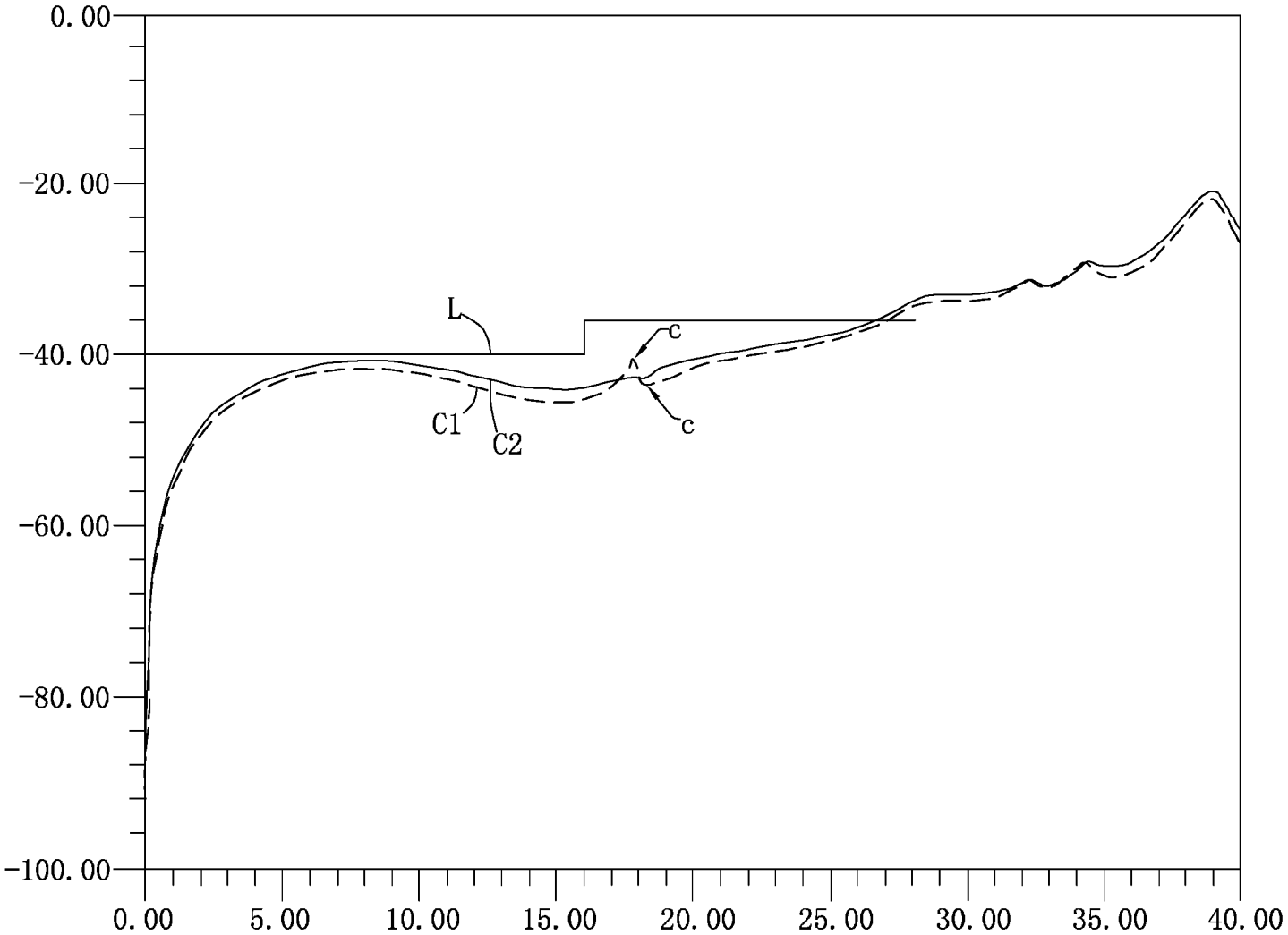
FIG. 14 is a curve chart of overall crosstalk of the first group of terminals of the electrical connector according to the first embodiment of the present invention compared with the related art.

FIG. 14 shows an overall crosstalk curve chart obtained by summing the near-end crosstalk and the far-end crosstalk in the electrical connector 100, where L is a general standard line of the crosstalk in the art, C1 is an overall crosstalk curve chart in the related art, and C2 is an overall crosstalk curve chart of the electrical connector 100 in this embodiment of the present invention. It can be seen that multiple sharp crosstalk resonance points c appearing on the curve C1 are improved on the curve C2, such that the overall crosstalk interference of the electrical connector 100 in this embodiment of the present invention is less than the overall crosstalk interference in the related art, and the high-frequency transmission performance is improved.

Further, the electrical connector in the related art uses an additional ground member to abut the ground terminals. In the electrical connector 100 of the present invention, the crosstalk may be improved without the additional ground member, thereby ensuring the effect of reducing the crosstalk interference, increasing the qualification rate of products, and facilitating the economic cost and the time cost.

Figure 2:
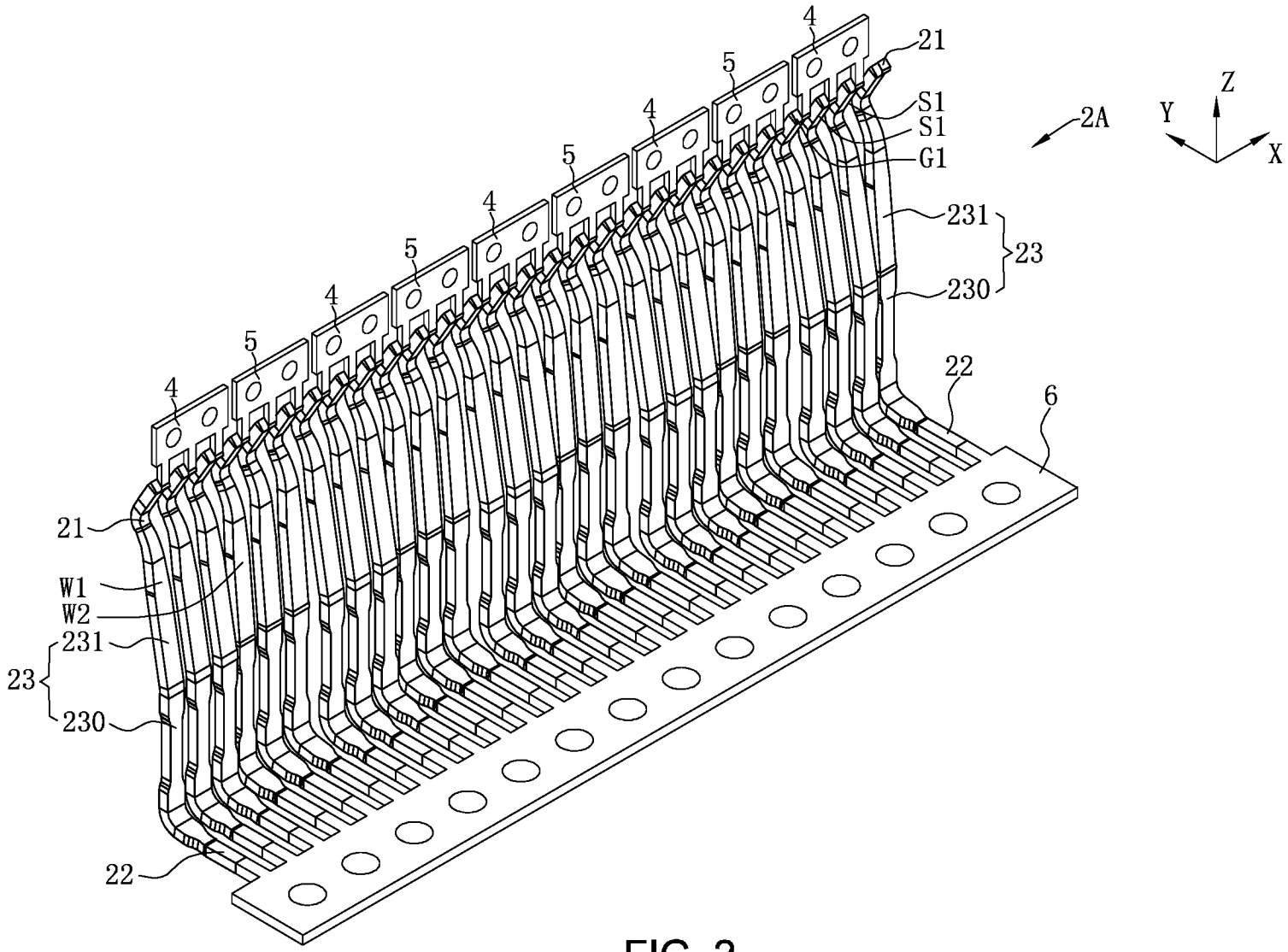
FIG. 2 is a perspective view of a first group of terminals of the electrical connector according to the first embodiment of the present invention.

Referring to FIG. 2, each terminal 2 of the first group of terminals 2A is formed by stamping a same metal plate. After the stamping procedure is completed, a tail end of each contact portion 21 of the terminals 2 in each first terminal unit W1 is connected to a first strip 4, thereby ensuring a stable distance between the pair of first signal terminals S1 to facilitate coupling of the high-frequency signals, and ensuring a stable distance between the first ground terminal G1 and the first signal terminals S1 to facilitate the backflow of the high-frequency signals and maintain the stable impedance of the first signal terminals S1. The tail end of each contact portion 21 of the terminals 2 in each second terminal unit W2 is connected to a second strip 5, and the second terminal unit W2 being connected to the second strip 5 achieves the same effect. Further, the first strip 4 and the second strip 5 are independently and separately provided, such that the first row of connecting portions 231 and the second row of connecting portions 231 may be staggered, thereby improving the crosstalk effect. Further referring to FIG. 2, FIG. 7B and FIG. 7C, the tail end of the mounting portions 220 of the terminals 2 in the first group of terminals 2A are flush in the left-right direction, and the tail ends of one row of mounting portions 220 are all connected to a third strip 6, such that a mounting center distance between each two of the row of mounting portions 220 may be maintained stable. The forming process of the second group of terminals 2B is the same as the forming process of the first group of terminals 2A, and descriptions thereof are not further elaborated herein.

Figure 6:
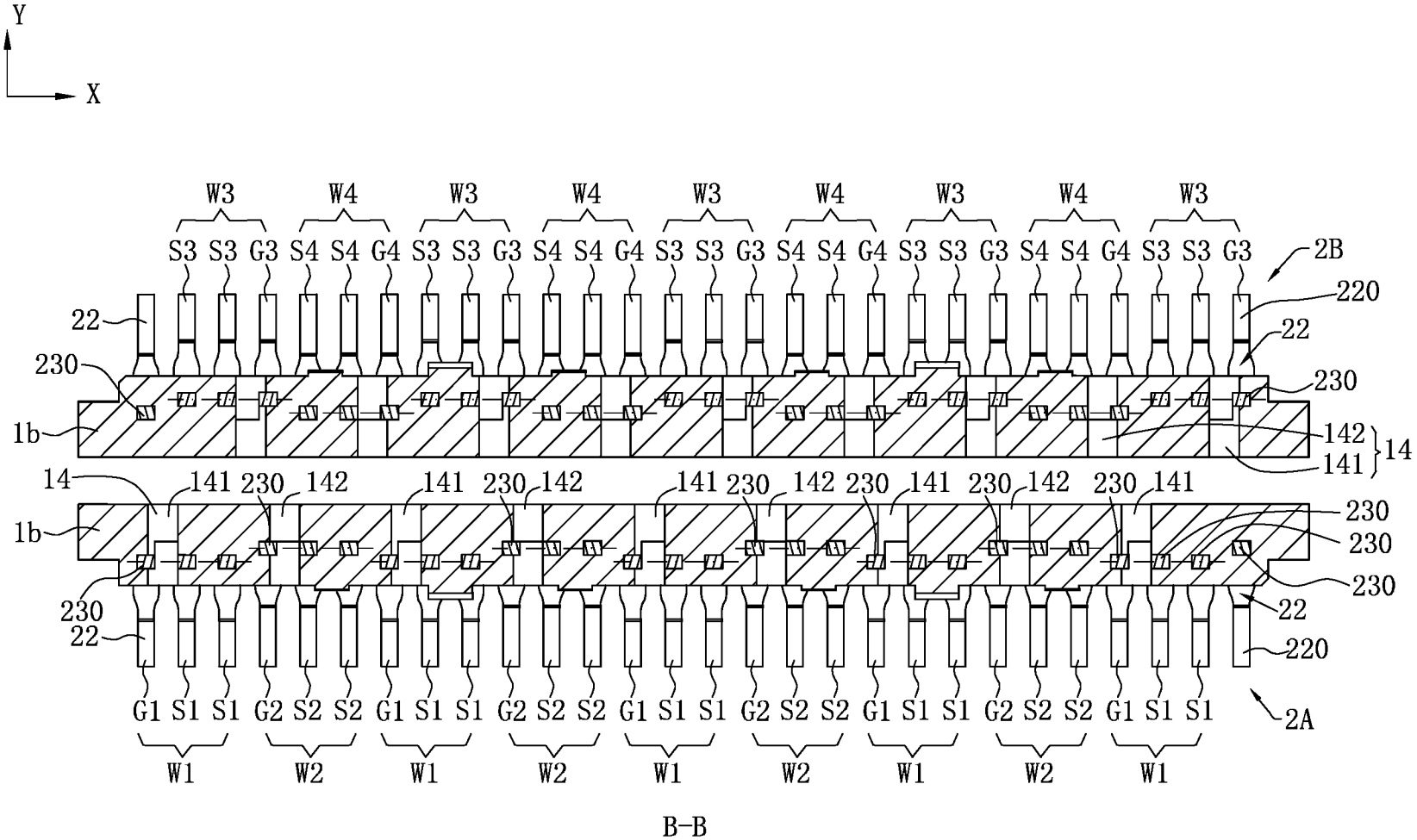
FIG. 6 is a sectional view of FIG. 4 along a line B-B.

Referring to FIG. 1, FIG. 5 and FIG. 6, the second group of terminals 2B have a plurality of third terminal units W3 and a plurality of fourth terminal units W4. The third terminal units W3 and the fourth terminal units W4 are alternately provided rightward from left thereof at intervals. Each third terminal unit W3 is formed by three terminals 2, including a third ground terminal G3 and two third signal terminals S3. Each fourth terminal unit W4 is formed by three terminals 2, including a fourth ground terminal G4 and two fourth signal terminals S4. Each first terminal unit W1, each second terminal unit W2, each third terminal unit W3 and each fourth terminal unit W4 all have the same configuration modes rightward from left thereof.

Referring to FIG. 1, FIG. 9 and FIG. 10, the first group of terminals 2A and the second group of terminals 2B are provided to be 180-degree inversely symmetrical along the width direction. Each third terminal unit W3 and the corresponding first terminal unit W1 are formed in a 180-degree inversely symmetrical structural design along the width direction, and each fourth terminal unit W4 and the corresponding second terminal unit W2 are formed in a 180-degree inversely symmetrical structural design along the width direction, such that the second group of terminals 2B also has the effect of reducing the crosstalk interference. The structural design described above includes the shape and dimension.

Referring to FIG. 5, FIG. 6 and FIG. 10, corresponding to the structures of the first group of terminals 2A, the contact portions 21 of the second group of terminals 2B are provided in a row and define a second contact plane P2 altogether, protruding into the other side of the insertion slot 10 along the width direction, and are electrically connected to a same side of the other row of contacts 201. The mounting portions 220 of the second group of terminals 2B are provided in a row along the left-right direction, and are one-by-one surface-soldered downward to the other row of pads (not shown). The extending size of each mounting portion 220 of the terminals 2 in each third terminal unit W3 is less than the extending size of each mounting portion 220 of the terminals 2 in each fourth terminal unit W4. The fixing portions 230 of the terminals 2 in each third terminal unit W3 form a third row of fixing portions 230. The fixing portions 230 of the terminals 2 in each fourth terminal unit W4 form a fourth row of fixing portions 230. Viewing along the left-right direction, the third row of fixing portions 230 and the fourth row of fixing portions 230 are staggered. In the width direction, the third row of fixing portions 230 is farther from the insertion slot 10 than the fourth row of fixing portions 230. That is, the third row of fixing portions 230 is close to the outer side relative to the fourth row of fixing portions 230. The connecting portions 231 of the terminals 2 in each third terminal unit W3 form a third row of connecting portions 231. The connecting portions 231 of the terminals 2 in each fourth terminal unit W4 form a fourth row of connecting portions 231. Viewing along the left-right direction, the third row of connecting portions 231 and the fourth row of connecting portions 231 are staggered. In the width direction, the third row of connecting portions 231 are farther from the insertion slot 10 than the fourth row of connecting portions 231. That is, the third row of connecting portions 231 is close to the outer side relative to the fourth row of connecting portions 231. Therefore, the third row of middle portions 23 as a whole deviates outward relative to the fourth row of middle portions 23.

Referring to FIG. 5 and FIG. 6, each pair of third signal terminals S3 and each pair of first signal terminals S1 are provided opposite to each other along the width direction. The first signal terminals S1 and the third signal terminals S3 both deviate outward, thereby increasing a directly facing distance between the first signal terminals S1 and the third signal terminals S3, reducing the crosstalk between the first signal terminals S1 and the third signal terminals S3, which is further conductive for the high-frequency signal transmission of the electrical connector 100.

Referring to FIG. 1, FIG. 9 and FIG. 10, a distance between the first contact plane P1 and the second contact plane P2 is less than a width of the insertion slot 10. After the electronic card 200 is inserted into the insertion slot 10, a row of contact portions 21 of the terminals 2 in each first terminal unit W1 and a row of contact portions 21 of the terminals 2 in each second terminal unit W2 both elastically deform outward, and the first contact plane P1 and the second contact plane P2 both deviate outward. However, the distance between the first contact plane P1 and the second contact plane P2 is still less than the width of the insertion slot 10, such that the electrical connection between the electronic card 200 and the electrical connector 100 is stable.

Referring to FIG. 7A, FIG. 7B, FIG. 7C, FIG. 9 and FIG. 10, a row of mounting portions 220 of the first group of terminals 2A and a row of mounting portions 220 of the second group of terminals 2B define a mounting plane P3 altogether, such that when the electrical connector 100 is mounted to the circuit board (not shown), each mounting portion 220 well surface-abuts the corresponding pad (not shown). A lower surface of each oblique transition portion 221 of the terminals 2 in each first terminal unit W1 forms an equal first included angle α with the mounting plane P3, and each oblique transition portion 221 of the terminals 2 in each second terminal unit W1 forms a second included angle β with the mounting plane P3, such that the first group of terminals 2A may be bent by a same mold to form the mounting portions 220, which is conductive to saving the cost. Further, the lower surface of each oblique transition portion 221 forming the first included angle α is higher than the lower surface of each oblique transition portion 221 forming the second included angle β, such that when the first group of terminals 2A is mounted downward to the circuit board (not shown), an elastic buffer space between the oblique transition portions 221 of the terminals 2 in each first terminal unit W1 and the mounting plane P3 is larger than an elastic buffer space between the oblique transition portions 221 of the terminals 2 in each second terminal unit W2 and the mounting plane P3. Since the first group of terminals 2A have the elastic buffer spaces in different sizes, the positions of one row of mounting portions 220 of the first group of terminals 2A may be adjusted favorably to ensure that the mounting portions 220 are located on the same mounting plane P3.

Referring to FIG. 1, FIG. 4 and FIG. 6, the insulating shell 1 includes an body 1*a* which is independently provided, and two insulating blocks 1*b* accommodated in the body 1*a*. One of the insulating blocks 1*b* and the first group of terminals 2A are injection-molded to form a first module (not numbered). The fixing portions 230 of the first group of terminals 2A are embedded in the insulating block 1*b*. The tail portions 22 of the first group of terminals 2A are exposed below the insulating block 1*b*. The connecting portions 231 and the contact portions 21 of the first group of terminals 2A are exposed above the insulating block 1*b*. The insulating block 1*b* has a plurality of adjustment holes 14 provided to run there through along the width direction. The adjustment holes 14 have a plurality of first holes 141, and each first hole 141 is located between the first ground terminal G1 and the first signal terminal S1 to adjust the impedance of the first signal terminal S1. The adjustment holes 14 have a plurality of second holes 142, and each second hole 142 is located between the second ground terminal G2 and the second signal terminal S2 to adjust the impedance of the second signal terminal S2. None of the adjustment holes 14 exists between each first terminal unit W1 and each second terminal unit W2. The other insulating block 1*b* and the second group of terminals 2B are injection-molded to form a second module. The second module and the first module (not numbered) are provided to be 180-degree inversely symmetrical.

Figure 11:
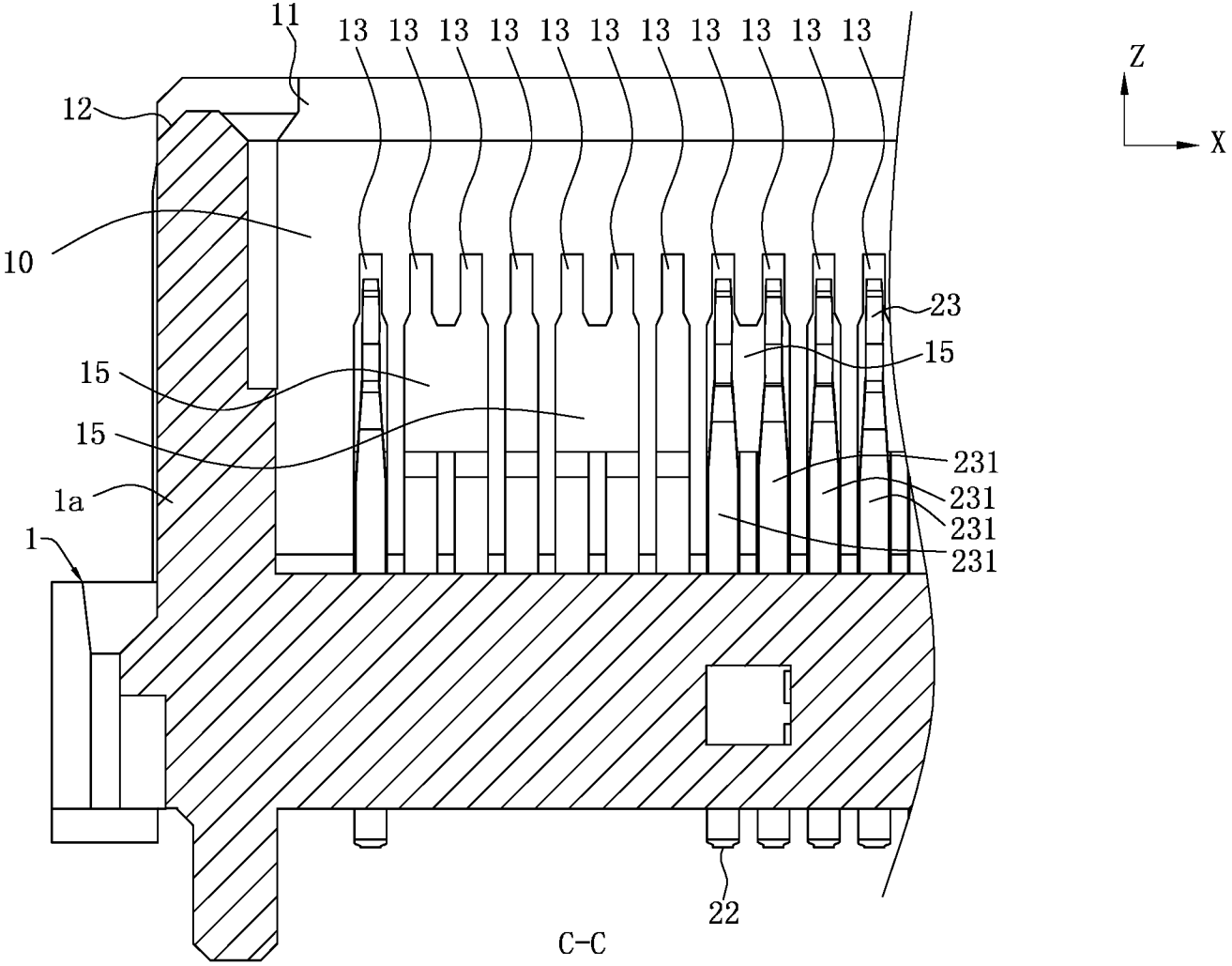
FIG. 11 is a sectional view of FIG. 10 along a line C-C.

Referring to FIG. 1, FIG. 10 and FIG. 11, the body 1*a* is provided along the left-right direction lengthwise. An upper surface of the body 1*a* is downward concavely provided to form the insertion slot 10 which is provided along the left-right direction lengthwise. The insertion slot 10 defines two side walls 11 and two end walls 12 on the body 1*a*. The two end walls 12 are respectively located at left and right ends of the insertion slot 10. Each side wall 11 extends along the left-right direction lengthwise, and has a row of terminal slots 13 provided at an equal interval. Each terminal slot 13 is in communication with the insertion slot 10 along the width direction. A lower surface of the body 1*a* is upwards sunken to form two mounting slots (not labeled, same below). Each mounting slot (not labeled) is provided along the left-right direction lengthwise and located below each row of terminal slots 13, and is in upward communication with each terminal slot 13 of the corresponding row of terminal slots 13. The first module (not numbered) and the second module (not shown) are inserted upward into the body 1*a* from the lower surface of the body 1*a*. Each insulating block 1*b* and the fixing portions 230 fixed to each insulating block 1*b* are correspondingly accommodated in one of the mounting slots (not labeled). Each tail portion 22 is exposed from the lower surface of the body 1*a*. Each connecting portion 231 is correspondingly accommodated in one terminal slot 13 and provided to suspend relative to the terminal slot 13. Each contact portion 21 protrudes into the insertion slot 10.

Referring to FIG. 11, one first terminal unit W1 and one second terminal unit W2 are hidden in FIG. 11, so as to observe the corresponding terminal slots 13 conveniently. The side wall 11 has a plurality of windows 15. One of the windows 15 is located between adjacent terminal slots 13 along the left-right direction to communicate the two terminal slots 13 along the left-right direction. One of the windows 15 is provided between the connecting portions 231 of each pair of first signal terminals S1, thereby reducing a dielectric coefficient between the pair of connecting portions 231 and enhancing the energy coupling between the pair of first signal terminals S1. One of the windows 15 is also provided between the connecting portions 231 of each pair of second signal terminals S2, thereby enhancing the energy coupling between the pair of second signal terminals S2. None of the windows 15 is provided between the first ground terminal G1 and the adjacent first signal terminal S1 as well as between the second ground terminal G2 and the adjacent second signal terminal S2.

Figure 15:
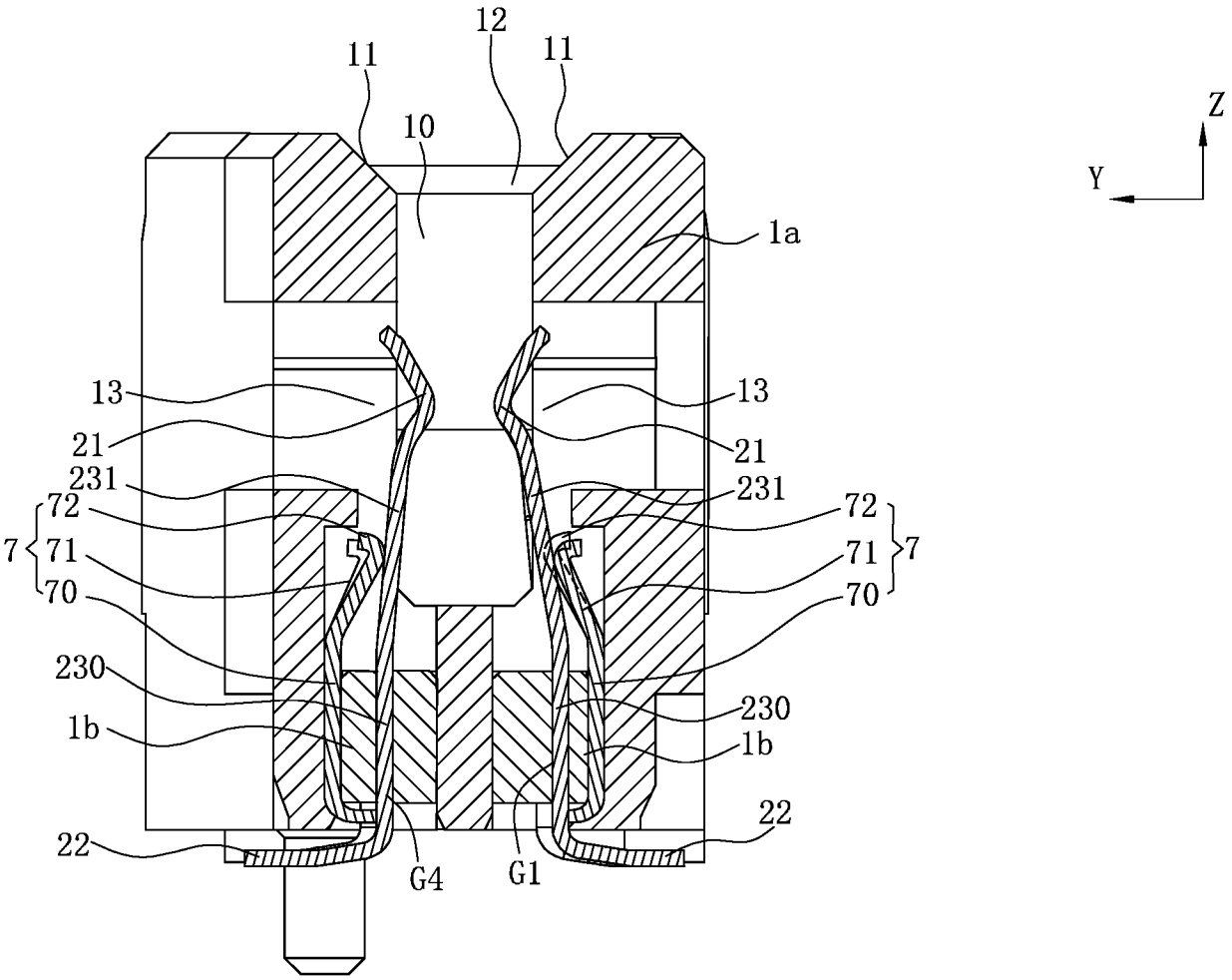
FIG. 15 is a sectional view of an electrical connector according to a second embodiment of the present invention.

FIG. 15 shows a second embodiment of the present invention, which is different from the first embodiment only in that: the electrical connector 100 is provided with a ground member 7 at the outer side of each insulating block 1*b* along the width direction. Each ground member 7 has a main body portion 70 extending along the left-right direction lengthwise, and a plurality of first abutting portions 71 and a plurality of second abutting portions 72 extending from each main body portion 70 towards an inner side. Taking the first module (not numbered) and one corresponding ground member 7 as an example below, the main body portion 70 covers the outer side of the insulating block 1*b*. Each first abutting portion 71 abuts each first ground terminal G1, and each second abutting portion 72 abuts each second ground terminal G2, thereby electrically connecting all the first ground terminals G1 to all the second ground terminals G2 of the first group of terminals 2A. Compared with the related art, a length of each first abutting portion 71 is less than a length of each second abutting portion 72. The first abutting portions 71 and the second abutting portions 72 are staggered along the left-right direction, and are grounded with the first ground terminals G1 and the second ground terminals G2 respectively along different planes, thereby ensuring a stable abutting effect between the ground member 7 and the first group of terminals 2A, and further reducing crosstalk. The matching between the other ground member 7 and the second module (not shown) is the same as the matching between the first module (not numbered) and the ground member 7, and descriptions thereof are not further elaborated herein.

Figure 16:
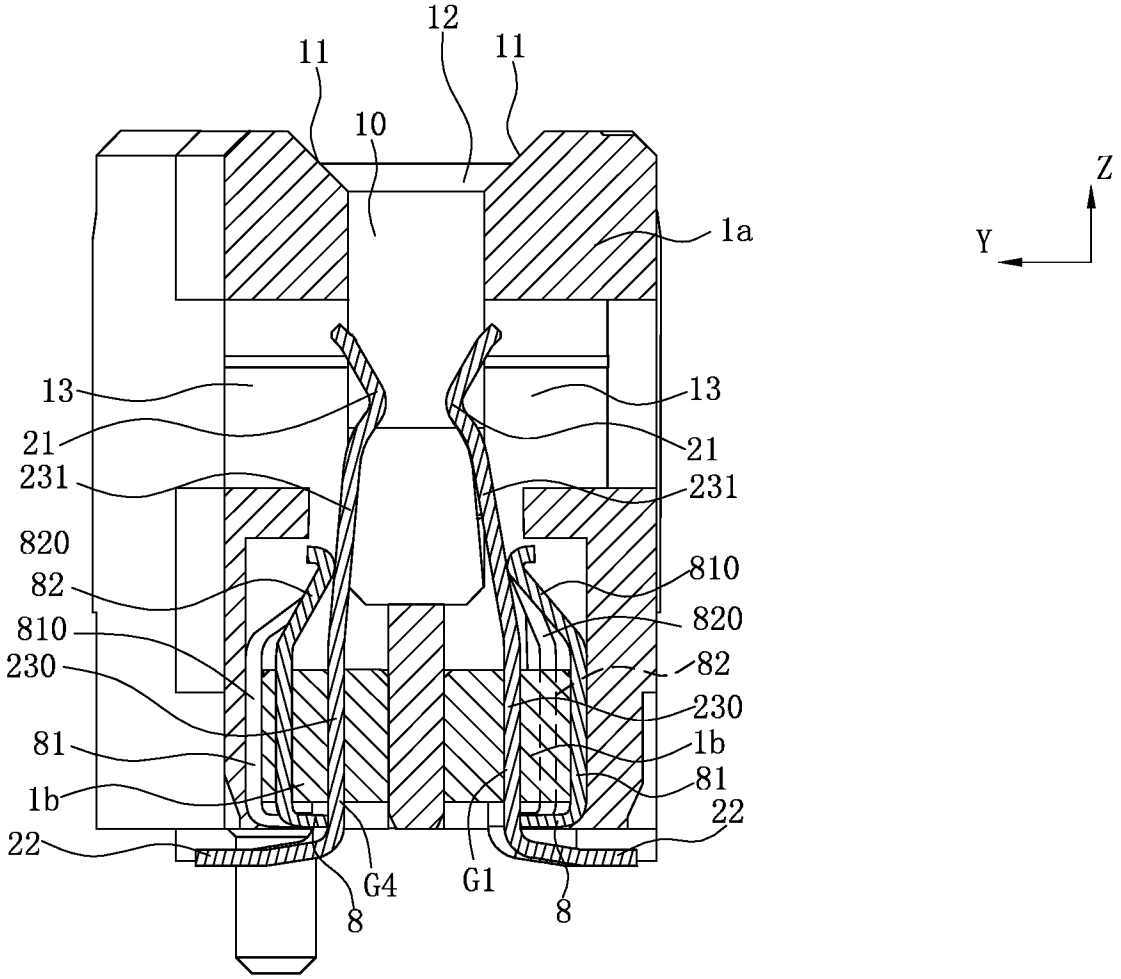
FIG. 16 is a sectional view of an electrical connector according to a third embodiment of the present invention.

FIG. 16 shows a third embodiment of the present invention, which is different from the first embodiment only in that: the electrical connector 100 is provided with a ground member 8 at the outer side of each insulating block 1*b* along the width direction. Taking the first module (not numbered) as an example below, the ground member 8 has a plurality of first main body portions 81 and a plurality of second main body portions 82 alternately provided along the left-right direction. Each first main body portion 81 corresponds to each first terminal unit W1 and extends along the left-right direction, and a first abutting portion 810 extends from each first main body portion 81 towards an inner side, and correspondingly abuts each first ground terminal G1. The quantity of the first abutting portions 810 corresponds to the quantity of the first ground terminals G1. Each second main body portion 82 corresponds to each second terminal unit W2 and extends along the left-right direction, and a second abutting portion 820 extends from each second main body portion 82 towards an inner side, and correspondingly urges each second ground terminal G2. The quantity of the second abutting portions 820 corresponds to the quantity of the second ground terminals G2. The first main body portions 81 and the second main body portions 82 are staggered along the left-right direction, and the first abutting portions 810 and the second abutting portions 820 respectively electrically abut the first ground terminals G1 and the second ground terminals G2 along different planes, thereby ensuring a stable abutting effect between the ground member 8 and the first group of terminals 2A, and further reducing crosstalk. The matching between the other ground member 8 and the second module (not shown) is the same as the matching between the first module (not numbered) and the ground member 8, and descriptions thereof are not further elaborated herein.

To sum up, the electrical connector according to certain embodiments of the present invention has the following beneficial effects:

1. The two adjacent signal units along the left-right direction in one embodiment of the present invention include a pair of first signal terminals S1 and a pair of second signal terminals S2. The first row of connecting portions 231 deviates outward relative to the second row of connecting portions 231. Compared with the related art where there is no deviation between adjacent terminal units (one terminal unit has one pair of signal terminals and one adjacent ground terminal) in one row of terminals, in one embodiment of the present invention, an average distance between the connecting portions 231 of two adjacent signal units is increased. When the high-frequency signals are transmitted from the electronic card 200 to the contact portions 21, the average distance between the connecting portions 231 relatively close to the contact portions 21 is increased, such that the near-end crosstalk interference and near-end crosstalk resonance between the first signal terminals S1 and the second signal terminals S2 may be reduced.

2. The connecting portions 231 of the terminals 2 in each first terminal unit W1 are provided in a same row, so as to ensure the high-frequency signals between the connecting portions 231 of one pair of first signal terminals S1 to be stable in energy coupling and the pair of first signal terminals S1 to be relatively close to one adjacent first ground terminal G1, thereby reducing the loop of the high-frequency signals in the pair of first signal terminals S1, which is conductive to maintaining the impedance balance of the first signal terminals S1 and enabling more energy dispersed by the connecting portions 231 of the first signal terminals S1 to the surrounding to return through the connecting portion 231 of the first ground terminal G1, and is conductive to improving near-end crosstalk.

3. The fixing portions 230 are relatively close to the mounting portions 220. The mounting portions 220 are configured to transmit the high-frequency signals to the circuit board (not shown). Compared with the related art where there is no deviation between adjacent terminal units (one terminal unit has one pair of signal terminals and one adjacent ground terminal) in one row of terminals, in one embodiment of the present invention, the first row of fixing portions 230 of the electrical connector 100 deviates outward relative to the second row of fixing portions 230, thereby increasing an average distance between each first terminal unit W1 and each second terminal unit W2, and reducing far-end crosstalk interference.

4. On the basis that the connecting portions 231 of the terminals 2 in each first terminal unit W1 are provided in a same row, the fixing portions 230 of the terminals 2 in each first terminal unit W1 are also provided in a same row, further enlarging a directly facing area between one pair of first signal terminals S1 and ensuring a stable distance between the pair of first signal terminals S1, thereby further ensuring the pair of first signal terminals S1 to be stable in energy coupling. In addition, a directly facing area between the first ground terminal G1 and the adjacent first signal terminal S1 is also enlarged, such that more interference crosstalk energy dispersed by the first signal terminal S1 to the surrounding flows back through the first ground terminal G1, and the far-end crosstalk interference is reduced.

5. Each terminal 2 of the first group of terminals 2A is formed by stamping a same metal plate. After the stamping procedure is completed, a tail end of each contact portion 21 of the terminals 2 in each first terminal unit W1 is connected to a first strip 4, thereby ensuring a stable distance between the pair of first signal terminals S1 to facilitate coupling of the high-frequency signals, and ensuring a stable distance between the first ground terminal G1 and the first signal terminals S1 to facilitate the backflow of the high-frequency signals and maintain the stable impedance of the first signal terminals S1. The tail end of each contact portion 21 of the terminals 2 in each second terminal unit W2 is connected to a second strip 5, and the second terminal unit W2 being connected to the second strip 5 achieves the same effect. Further, the first strip 4 and the second strip 5 are independently and separately provided, such that the first row of connecting portions 231 and the second row of connecting portions 231 may be staggered, thereby improving the crosstalk effect.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, electrically connecting a first electrical module and a second electrical module, and configured for insertion by the first electrical module along a first direction, the first electrical module having a row of contacts, the electrical connector comprising:

a plurality of terminals, comprising a first group of terminals arranged in a row along a second direction, wherein the second direction is perpendicular to the first direction, the first group of terminals comprises a plurality of signal terminals and a plurality of ground terminals, the signal terminals and the ground terminals of the first group of terminals form at least one first terminal unit and at least one second terminal unit, each of the first terminal unit and each of the second terminal unit are arranged to be adjacent in the second direction, the first terminal unit is formed by sequentially arranging at least one of the signal terminals and at least one of the ground terminals along the second direction in a configuration mode, and a quantity and a configuration mode of the terminals in the second terminal unit are identical to a quantity and the configuration mode of the terminals in the first terminal unit;

wherein each of the terminals has a contact portion, a tail portion electrically connected to the second electrical module, and a middle portion located between the contact portion and the tail portion, the contact portion of each of the terminals in the first group of terminals abuts a same side of one of the contacts of the first electrical module, the middle portions of the terminals in the first terminal unit form a first row of the middle portions in the second direction, the middle portions of the terminals in the second terminal unit form a second row of the middle portions in the second direction, and viewing from the second direction, the first row of the middle portions and the second row of the middle portions are staggered; and an insulating shell, fixed to the first group of terminals.

2. The electrical connector according to claim 1, wherein the first terminal unit is formed by one of the signal terminals and one of the ground terminals; or the first terminal unit is formed by a pair of the signal terminals transmitting a differential signal and two of the ground terminals, and the configuration mode of the first terminal unit is that the two of the ground terminals and the pair of the signal terminals are in a "ground-signal-signal-ground" order along the second direction; or the first terminal unit is formed by a pair of the signal terminals and one of the ground terminals, and the configuration mode of the first terminal unit is that the one of the ground terminals and the pair of the signal terminals are in a "signal-signal-ground" order along the second direction.

3. The electrical connector according to claim 1, wherein each of the contact portions of the first group of terminals is at least partially provided in a row along the second direction, each of the tail portions of the first group of terminals is at least partially provided in a row along the second direction, an extending size of the middle portion of each of the terminals in the first terminal unit is greater than an extending size of the middle portion of each of the terminals in the second terminal unit; and an extending size of the tail portion of each of the terminals in the first terminal unit is less than an extending size of the tail portion of each of the terminals in the second terminal unit.

4. The electrical connector according to claim 1, wherein a third direction is defined to be perpendicular to the first direction and the second direction, the tail portion of each of the terminals has a mounting portion extending in parallel along the third direction and surface-mounted to the second electrical module, and each of the mounting portions of the terminals in the first terminal unit is shorter than each of the mounting portions of the terminals in the second terminal unit.

5. The electrical connector according to claim 4, wherein the tail portion of each of the terminals has an oblique transition portion obliquely extending from the middle portion to the tail portion along the third direction, the mounting portions of the tail portions of the terminals define a mounting plane altogether, the oblique transition portions of the terminals in the first terminal unit are farther from the mounting plane than the oblique transition portions of the terminals in the second terminal unit, each of the oblique transition portions of the terminals in the first terminal unit forms a same first included angle relative to the mounting plane, each of the oblique transition portions of the terminals in the second terminal unit forms a second included angle relative to the mounting plane, and the first included angle is equal to the second included angle.

6. The electrical connector according to claim 1, wherein the middle portion of each of the terminals has a fixing portion fixed to the insulating shell, the fixing portions of the terminals in each of the at least one first terminal unit are provided in a same row along the second direction to form a first row of fixing portions, the fixing portions of the terminals in each of the at least one second terminal unit are provided in a same row along the second direction to form a second row of fixing portions, and viewing along the second direction, the first row of fixing portions and the second row of fixing portions are staggered.

7. The electrical connector according to claim 6, wherein the middle portion of each of the terminals has a connecting portion extending from the fixing portion and connecting the contact portion and the fixing portion, the connecting portions of the terminals in each of the at least one first terminal unit are provided in a same row along the second direction to form a first row of connecting portions, the connecting portions of the terminals in each of the at least one second terminal unit are provided in a same row along the second direction to form a second row of connecting portions, and viewing along the second direction, the first row of connecting portions and the second row of connecting portions are staggered.

8. The electrical connector according to claim 1, wherein a third direction is defined to be perpendicular to the first direction and the second direction, the contact portions of the first group of terminals define a first contact plane altogether, the first contact plane is parallel to the second direction, and the first row of the middle portions is farther from the first contact plane than the second row of the middle portions in the second direction.

9. The electrical connector according to claim 1, wherein a third direction is defined to be perpendicular to the first direction and the second direction, the insulating shell is concavely provided with an insertion slot along the first direction to accommodate the first electrical module, each of the first group of terminals is fixed on one side of the insertion slot along the third direction, each of contact portions of the first group of terminals protrudes into the one side of the insertion slot to be electrically connected to the first electrical module, and the first row of the middle portions is farther from the insertion slot than the second row of the middle portions in the third direction.

10. The electrical connector according to claim 9, wherein the terminals further comprise a second group of terminals arranged in a row along the second direction and fixed on the other side of the insertion slot along the third direction, and each of the contact portions of the terminals the second group of terminals protrudes into the other side of the insertion slot to be electrically connected to the first electrical module;

the second group of terminals comprise a plurality of signal terminals and a plurality of ground terminals, the signal terminals and the ground terminals of the second group of terminals form at least one third terminal unit and at least one fourth terminal unit, the third terminal unit is formed by at least one of the signal terminals and at least one of the ground terminals, and the fourth terminal unit is formed by at least one of the signal terminals and at least one of the ground terminals; and one of the at least one third terminal unit and one of the at least one first terminal unit are provided to be 180-degree inversely symmetrical along the third direction, and one of the at least one fourth terminal unit and one of the at least one second terminal unit are provided to be 180-degree inversely symmetrical along the third direction.

11. The electrical connector according to claim 1, wherein each of the contact portions of the terminals in the first terminal unit is connected to a first strip, each of the contact portions of the terminals in the second terminal unit is connected to a second strip, and the first strip and the second strip are provided independently.

12. The electrical connector according to claim 1, wherein the insulating shell comprises an insulating block, each of the middle portions of the first group of terminals is fixed to the insulating block by injection molding, a plurality of adjustment holes are concavely formed on a surface of the insulating block, the adjustment holes comprises at least one first hole and at least one second hole, one of the at least one first hole is located between one of the ground terminals and one of the signal terminals of the first terminal unit adjacent to each other, one of the at least one second hole is located between one of the ground terminals and one of the signal terminals of the second terminal unit adjacent to each other, and none of the adjustment holes exists between the first terminal unit and the second terminal unit adjacent to each other.

13. The electrical connector according to claim 1, further comprising a ground member, wherein the ground member has a main body portion and a plurality of abutting portions connected to the main body portion, the abutting portions have at least one first abutting portion abutting at least one of the ground terminals of the first terminal unit and at least one second abutting portion abutting at least one of the ground terminals of the second terminal unit, and a length of the first abutting portion is not equal to a length of the second abutting portion.

14. The electrical connector according to claim 1, further comprising a ground member, wherein the ground member has a first main body portion, a second main body portion, at least one first abutting portion connected to the first main body portion and at least one second abutting portion connected to the first main body portion, the first main body portion crosses over one of the at least one first terminal unit along the second direction, one of the at least one first abutting portion abuts a corresponding one of the at least one ground terminal of the first terminal unit, the second main body portion crosses over one of the at least one second terminal unit along the second direction, one of the at least one second abutting portion abuts a corresponding one of the at least one ground terminal of the second terminal unit, and viewing from the second direction, the first main body portion and the second main body portion are staggered.

15. An electrical connector, configured for insertion by a first electrical module along a first direction, the first electrical module having a row of contacts arranged along a second direction perpendicular to the first direction, the electrical connector comprising:

a plurality of terminals, comprising a first group of terminals arranged in a row along a second direction, wherein each of the terminals has a contact portion and a middle portion extending to the contact portion, each of the contact portions of the terminals in the first group of terminals is electrically connected to a same side of each of the contacts in the row of contacts, and each of the middle portions of the terminals in the first group of terminals is located at the same side of each of the contacts in the row of contacts;

wherein the terminals comprise a plurality of first ground terminals, a plurality of second ground terminals, a plurality of first signal terminals and a plurality of second signal terminals, at least one of the first ground terminals and at least one of the first signal terminals are provided adjacent to each other to form a first terminal unit, at least one of the second ground terminals and at least one of the second signal terminals are provided adjacent to each other to form a second terminal unit, the first terminal unit and the second terminal unit are arranged adjacent to each other along the second direction, the middle portions of the terminals in the first terminal unit form a first row of the middle portions in the second direction, the middle portions of the terminals in the second terminal unit form a second row of the middle portions in the second direction, and viewing from the second direction, the first row of the middle portions and the second row of the middle portions are staggered; and an insulating shell, fixed to the first group of terminals.

16. The electrical connector according to claim 15, wherein each of the first terminal unit has one of the first ground terminals and one of the first signal terminals, and each of the second terminal unit has one of the second ground terminals and one of the second signal terminals, and the configuration mode of each of the second terminal unit and the configuration mode of each of the first terminal unit are identical; or each of the first terminal unit has one of the first ground terminals and a pair of the first signal terminals, thus forming a "signal-signal-ground" configuration mode in the second direction, each of the second terminal unit has one of the second ground terminals and a pair of the second signal terminals, and the configuration mode of each of the second terminal unit and the configuration mode of each of the first terminal unit are identical; or each of the first terminal unit has a pair of the first ground terminals and a pair of the first signal terminals, thus forming a "ground-signal-signal-ground" configuration mode in the second direction, each of the second terminal unit has a pair of the second ground terminals and a pair of the second signal terminals, and the configuration mode of each of the second terminal unit and the configuration mode of each of the first terminal unit are identical.

17. The electrical connector according to claim 16, wherein each of the terminals has a tail portion configured to be electrically connected with a second electrical module, the tail portion of each of the terminals enables the middle portion of each of the terminals to be located between the contact portion of each of the terminals and the tail portion of each of the terminals; the tail portion of each of the terminals has a mounting portion and surface-mounted to the second electrical module, and each of the mounting portions of the terminals in the first terminal unit is shorter than each of the mounting portions of the terminals in the second terminal unit.

18. The electrical connector according to claim 15, wherein the insulating shell comprises an insulating block, each of the middle portions of the first group of terminals is fixed to the insulating block by injection molding, a plurality of adjustment holes are concavely formed on a surface of the insulating block, the adjustment holes comprises at least one first hole and at least one second hole, one of the at least one first hole is located between one of the ground terminals and one of the signal terminals adjacent to each other, one of the at least one second hole is located between one of the ground terminals and one of the signal terminals adjacent to each other, and none of the adjustment holes exists between the first terminal unit and the second terminal unit adjacent to each other.

19. The electrical connector according to claim 15, further comprising a ground member, wherein the ground member has a main body portion and a plurality of abutting portions connected to the main body portion, the abutting portions have at least one first abutting portion abutting at least one of the first ground terminals and at least one second abutting portion abutting at least one of the second ground terminals, and a length of the first abutting portion is not equal to a length of the second abutting portion.

20. The electrical connector according to claim 15, further comprising a ground member, wherein the ground member has a first main body portion, a second main body portion, at least one first abutting portion connected to the first main body portion and at least one second abutting portion connected to the first main body portion, the first main body portion crosses over the first terminal unit along the second direction, one of the at least one first abutting portion abuts one of the first ground terminals, the second main body portion crosses over the second terminal unit along the second direction, one of the at least one second abutting portion abuts one of the second ground terminals, and viewing from the second direction, the first main body portion and the second main body portion are staggered.

* * * * *